US009816331B2

(12) United States Patent
Le

(10) Patent No.: US 9,816,331 B2
(45) Date of Patent: Nov. 14, 2017

(54) APPARATUS AND METHODS OF RUNNING CASING

(71) Applicant: Weatherford Technology Holdings, LLC, Houston, TX (US)

(72) Inventor: Tuong Thanh Le, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 71 days.

(21) Appl. No.: 14/152,600

(22) Filed: Jan. 10, 2014

(65) Prior Publication Data

US 2014/0196910 A1 Jul. 17, 2014

Related U.S. Application Data

(60) Provisional application No. 61/751,830, filed on Jan. 12, 2013.

(51) Int. Cl.

| | |
|---|---|
| ***E21B 17/02*** | (2006.01) |
| ***E21B 17/08*** | (2006.01) |
| ***E21B 7/20*** | (2006.01) |

(52) U.S. Cl.

CPC ..... *E21B 17/08* (2013.01); *E21B 7/20* (2013.01)

(58) Field of Classification Search

USPC ..... 166/380, 206

See application file for complete search history.

(56) References Cited

U.S. PATENT DOCUMENTS

| | | | |
|---|---|---|---|
| 3,123,160 | A | 3/1964 | Kammerer |
| 3,603,412 | A | 9/1971 | Kammerer, Jr. et al. |
| 3,656,564 | A | 4/1972 | Brown |
| 3,661,218 | A | 5/1972 | Brown |
| 4,544,041 | A | 10/1985 | Rinaldi |
| 5,197,553 | A | 3/1993 | Leturno |
| 5,472,057 | A | 12/1995 | Winfree |
| 5,553,667 | A | 9/1996 | Budde et al. |
| 6,059,053 | A | 5/2000 | McLeod |
| 7,334,650 | B2 | 2/2008 | Giroux et al. |
| 7,784,552 | B2 | 8/2010 | Brouse |
| 7,926,590 | B2 | 4/2011 | Eriksen et al. |
| 7,938,201 | B2 | 5/2011 | Giroux et al. |
| 8,146,672 | B2 | 4/2012 | Eriksen |
| 8,839,880 | B2 | 9/2014 | Trevino et al. |
| 2004/0216892 | A1 | 11/2004 | Giroux et al. |
| 2011/0011646 | A1 | 1/2011 | Giroux et al. |
| 2012/0006567 | A1 | 1/2012 | Giroux et al. |

OTHER PUBLICATIONS

PCT International Search Report and Written Opinion for Application PCT/US2014/011141, dated Nov. 10, 2014.

Australian Examination Report dated Feb. 16, 2016, for Australian Patent Application No. 2014205201.

Australian Examination Report dated Jun. 29, 2016, for Australian Patent Application No. 2014205201.

*Primary Examiner* — Taras P Bemko

(74) *Attorney, Agent, or Firm* — Patterson & Sheridan, LLP

(57) ABSTRACT

In one embodiment, the first casing string is releasably coupled to a second casing string using a latch assembly. The second casing string is released from the conductor after the first casing string is properly positioned in the wellbore. The latch assembly is configured to release the coupling by manipulating the second casing string relative to the first casing string.

19 Claims, 38 Drawing Sheets

APPARATUS AND METHODS OF RUNNING CASING

BACKGROUND OF THE INVENTION

Field of the Invention

Embodiments of the present invention generally relate to methods and apparatus for drilling with casing. More particularly, the present invention relates to methods and apparatus for coupling two strings of casing.

Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

In general, drilling with casing allows the drilling and positioning of a casing string in a wellbore in a single trip. However, installation of multiple casing strings still requires multiple trips. For example, installation of the conductor casing and the installation of surface casing are generally performed using separate trips.

There is a need, therefore, for improved methods and apparatus for coupling two strings of casing. There is also a need for apparatus and methods for drilling and running to casings in a single trip.

SUMMARY OF THE INVENTION

In one embodiment, the first casing string is releasably coupled to a second casing string using a latch assembly. The second casing string is released from the conductor after the first casing string is properly positioned in the wellbore. The latch assembly is configured to release the coupling by manipulating the second casing string relative to the first casing string.

In another embodiment, a method of coupling a first tubular to a second tubular includes disposing the second tubular in the first tubular, wherein the first tubular includes a latch member and the second tubular includes a mating latch member; engaging the latch member with the mating latch member by extending the latch member toward the mating latch member; maintaining engagement of the latch member to the mating latch member; and applying a downward force to retract the latch member, thereby disengaging the latch member from the mating latch member.

In yet another embodiment, maintaining the engagement comprises rotating the latch member relative to the first tubular to move the latch member to a lock position.

In yet another embodiment, the method further includes rotating the latch member relative to the first tubular to unlock the latch member before applying the downward force.

In yet another embodiment, the latch member is extended in a direction substantially parallel to a radial direction.

In another embodiment, a latch assembly includes a latch housing having a latch member; a latch mandrel having a mating latch member, wherein the latch mandrel is disposed in the latch housing; and an elevator for extending and retracting the latch member relative to the mating latch member for engaging or disengaging the latch member to the mating latch member, wherein the latch member is rotatable relative to the elevator to lock the latch member in an engaged position with the mating latch member.

In another embodiment, a casing assembly includes a first casing having a first latch member; a second casing having a second latch member, wherein the second casing is disposed in the first casing; and an elevator for extending and retracting the first latch member relative to the second latch member, wherein the first latch member is rotatable relative to the elevator to lock the first latch member in an engaged position with the second latch member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 22A-D are different views of the elevator and keys in the retracted position.

FIGS. 23A-C are different views of the keys of the elevator engaged with the latch mandrel.

FIGS. 24A-B are different views of the keys of the elevator partially rotated.

FIGS. 25A-B are different views of the keys of the elevator in the locked position.

FIG. 26B shows the keys moving partially to the right. FIGS. 26A,C show the keys after moving to the right.

FIGS. 27A-B are different views of the keys after retraction.

DETAILED DESCRIPTION OF THE PREFERRED EMBODIMENT

In one embodiment, a method for drilling and casing a subsea wellbore involves drilling the wellbore and installing casing in the same trip. The method may involve drilling or jetting a conductor casing string, to which a low pressure wellhead is attached, into place in the sea bed. Thereafter, a second casing string having an earth removal member at its lower end and a high pressure subsea wellhead at its upper end may be drilled or jetted into place, such that the drilling extends the depth of the wellbore. In one embodiment, the second casing string is releasably coupled to the conductor during run-in. The second casing string is released from the conductor after the conductor is properly positioned in the wellbore. In another embodiment, the conductor and the second casing may be coupled using a latch assembly configured to release the coupling by manipulating the casing string from surface.

Figure 1A:
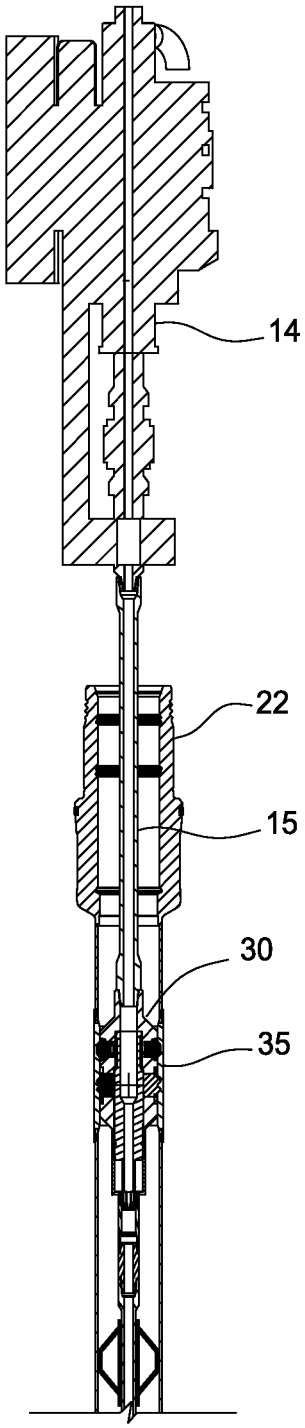
FIGS. 1A and 1B show an exemplary drilling system suitable for drilling a subsea wellbore.
Figure 1B:
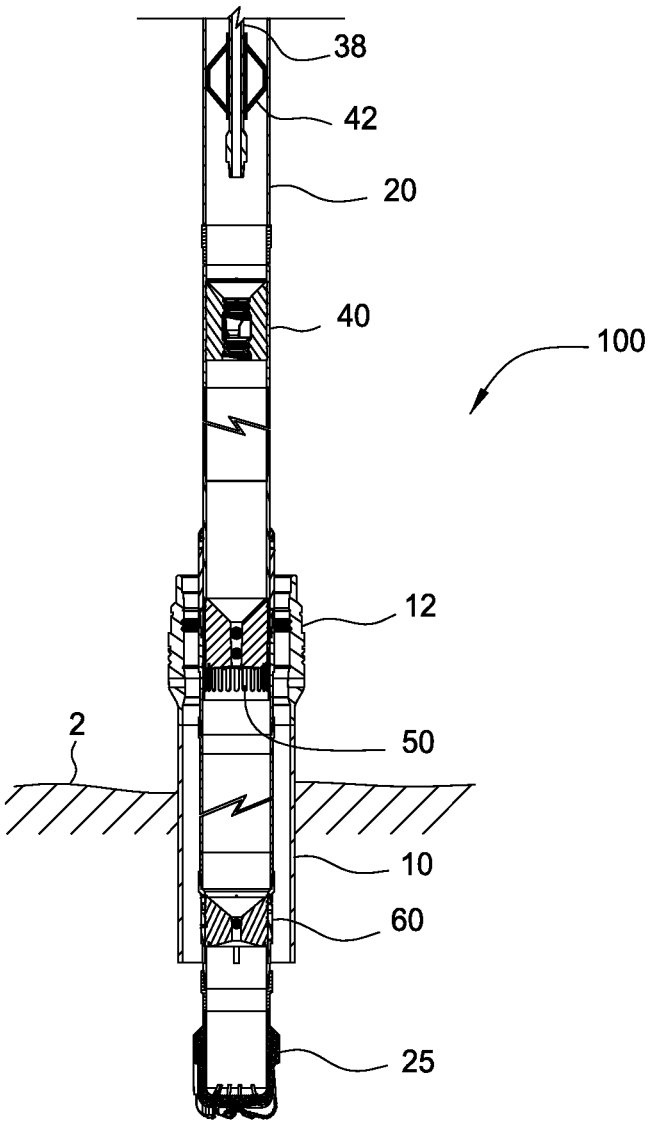

FIGS. 1A and 1B show an exemplary drilling system 100 suitable for drilling a subsea wellbore. The drilling system is shown partially inserted in a pre-existing conductor casing 10 positioned on the sea floor 2. The conductor casing 10 is equipped with a low pressure wellhead 12. In an exemplary embodiment, the conductor casing 10 may be releasably attached to the drilling system 100 such that the conductor casing 10 and the drilling system 100 may be run-in in a single trip.

The drilling system 100 includes casing 20 having a high pressure wellhead 22 at its upper end and an earth removal member 25, such as a drill bit, at its lower end. A drill string 15 is releasably connected to a casing 20 using a running tool 30. The drill string 15 may extend from a top drive 14 and operatively connects the casing string 20 to a drilling unit, such as a floating drilling vessel or a semi-submersible drilling rig. The running tool 30 is shown connected to a setting sleeve 35 positioned in the casing 20. Alternatively, the running tool 30 may be connected to the high pressure wellhead 22. The running tool 30 may have an inner string 38 attached to a lower end thereof. The drilling system 100 may also include a float sub 40 to facilitate the cementing operation. As shown, the inner string 38 is above the float sub 40. Alternatively, the inner string 38 may be connected to the float sub 40. One or more centralizers 42 may be used to centralize the inner string 38 in the casing 20. In another embodiment, the drilling system 100 may use a jetting member instead of or in addition to an earth removal member.

Figure 2:
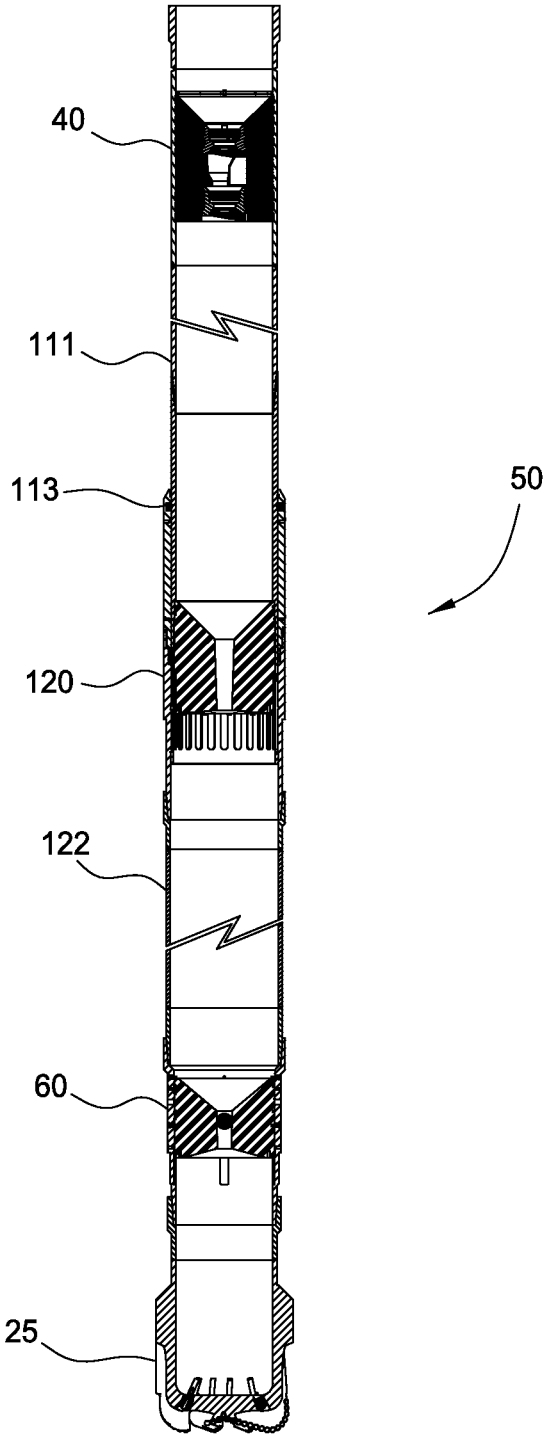
FIG. 2 illustrates an embodiment of a retractable joint suitable for use with the drilling system of FIGS. 1A and 1B.

An optional retractable joint 50 is used to couple the earth removal member 25 to the casing 20. The retractable joint 50 may be operated to effectively reduce the length of the casing 20. To that end, the retractable joint 50 includes a telescoping portion and optionally, a circulation sub 60. FIG. 2 illustrates an embodiment of a retractable joint 50 suitable for use with the drilling system of FIG. 1. The telescoping portion includes an upper telescoping casing 111 partially disposed in a larger diameter retraction sub 120. A seal 113 is provided on the retraction sub 120 for sealing engagement with the perimeter of the upper telescoping casing 111. The retraction sub 120 is connected to a lower telescoping casing 122, which may be optionally connected to a circulation sub 60. In turn, the circulation sub 60 is connected to the earth removal member 25.

Figure 3A:
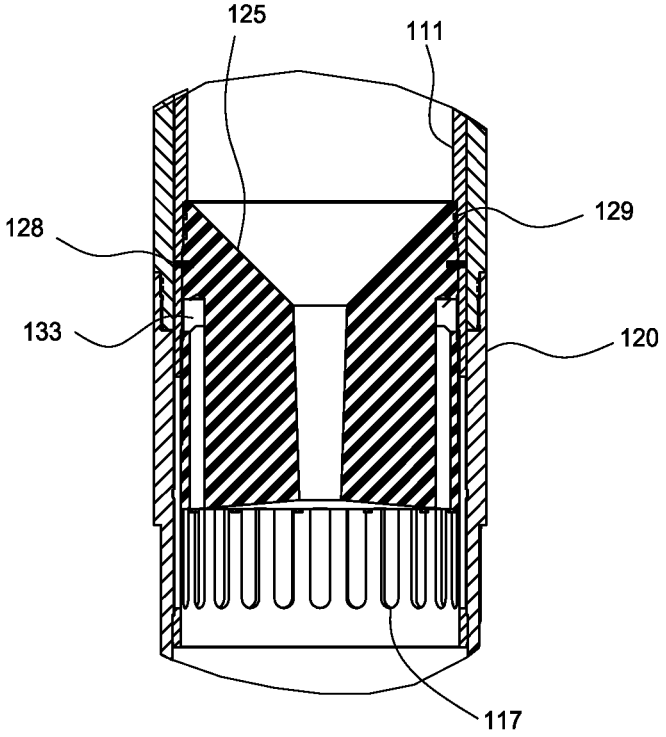
FIGS. 3A-B are different cross-sectional views of the telescoping portion in the unactivated position.
Figure 3B:
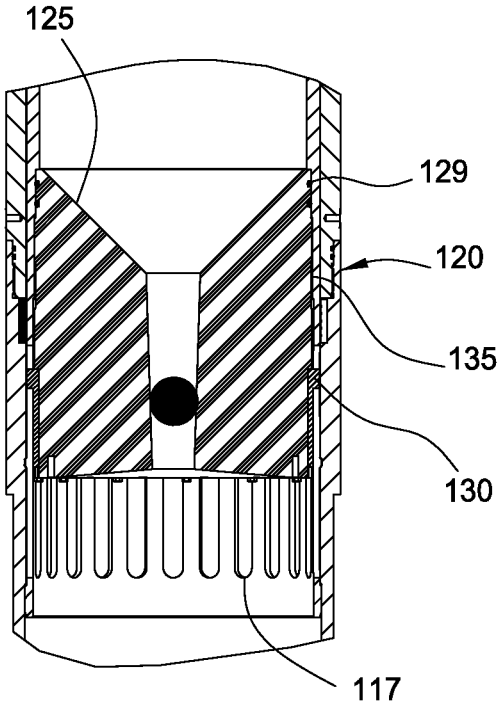

FIGS. 3A-B are partial cross-sectional views of the telescoping portion in the unactivated position. The upper telescoping casing 111 has elongated axial grooves 117 circumferentially spaced around its lower end, which overlaps the retraction sub 120. A shear sleeve 125 is disposed in and releasably connected to the upper telescoping casing 111 using one or more shearable connections 128, for example, shear pins. One or more seals 129 such as o-rings may be positioned between the shear sleeve 125 and the upper telescoping casing 111. The shear sleeve 125 is equipped with one or more keys 130 adapted to move in a respective axial groove 117 of the upper telescoping casing 111. The keys 130 prevent the shear sleeve 125 from rotating relative to the upper telescoping casing 111, which facilitates the drill out of the shear sleeve 125. One or more channels 133 are formed in the shear sleeve 125 to assist in re-establishing fluid communication during its operation, as will be described below. The channels 133 have one end terminating in a sidewall of the shear sleeve 125 and another end terminating in at the bottom of the shear sleeve 125.

Figure 4:
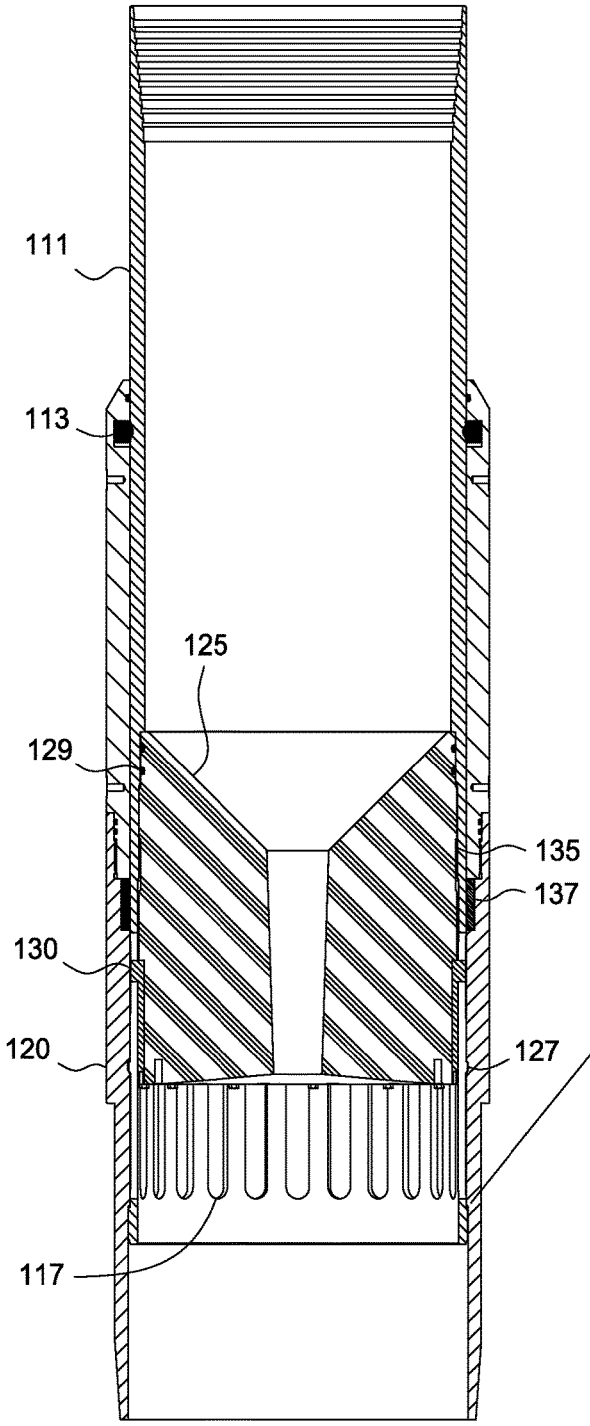
FIGS. 4 and 5 are partial views of the telescoping portion of the retractable joint.
Figure 6:
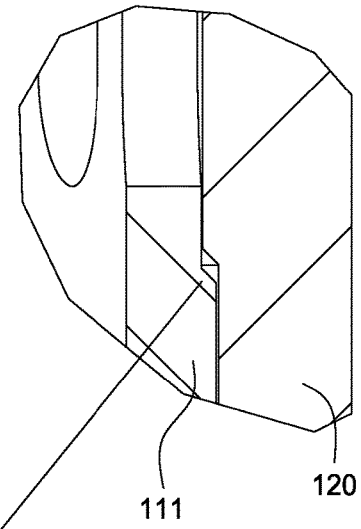
FIG. 6 is an enlarged partial view of FIG. 4.
Figure 4A:
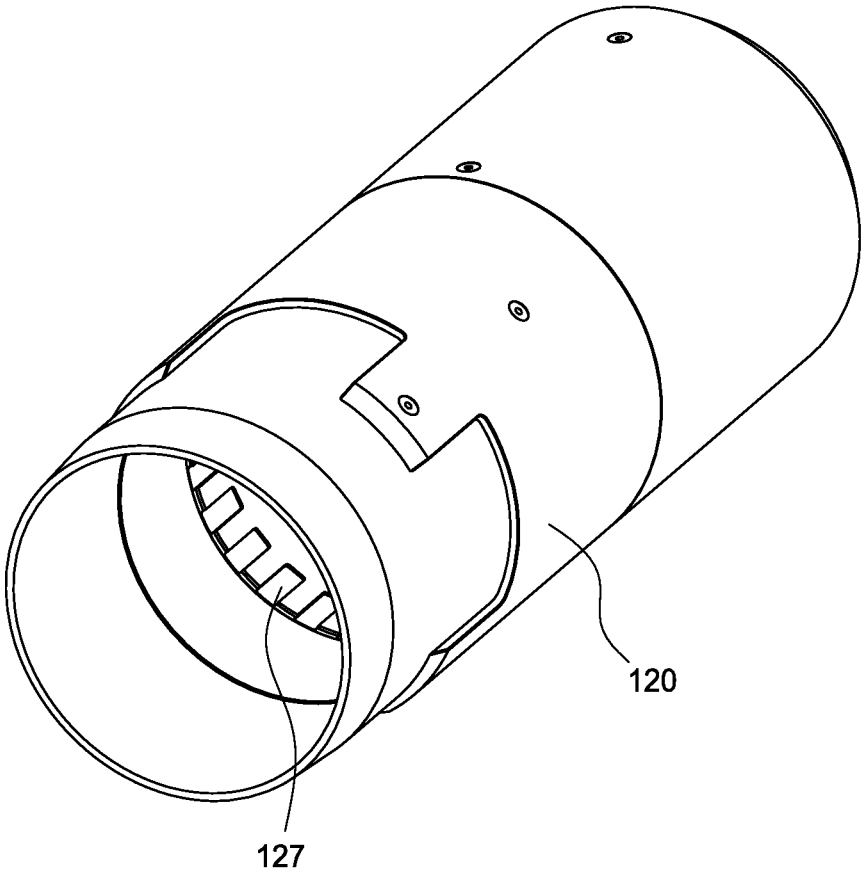
FIG. 4A is a perspective view of the retraction sub.
Figure 5:
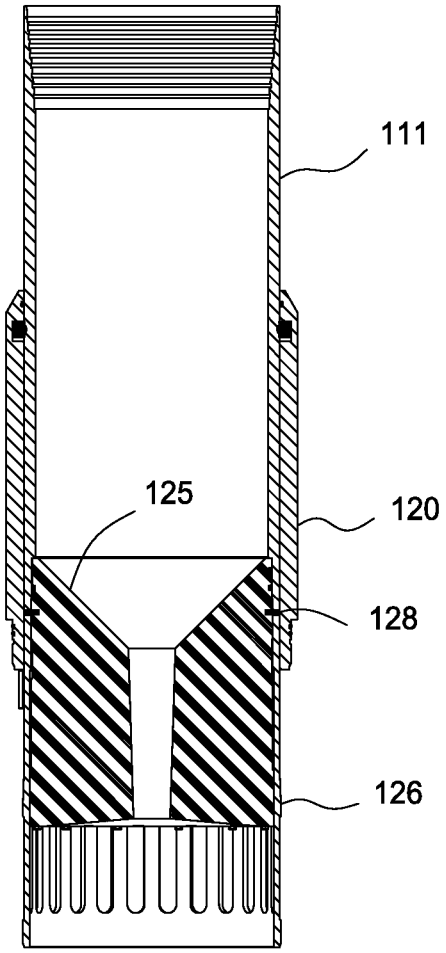
Figure 5A:
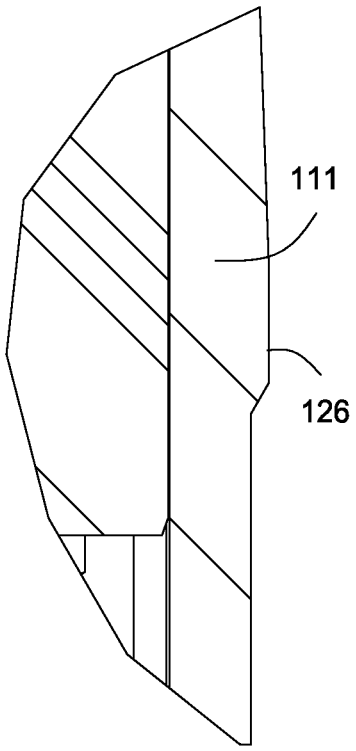
FIG. 5A is an enlarged partial view of FIG. 5.

FIGS. 4-6 show the transfer of torque and axial load between the upper telescoping casing 111 and the retraction sub 120. As shown in FIGS. 4, 4A, 5, and 5A, the upper telescoping casing 111 has raised tabs 126 formed on its outer surface which interact with corresponding pockets 127 in the inner surface of the retraction sub 120. The tabs 126 and the pockets 127 have mating shoulders such that axial load may be transferred therebetween. FIG. 5A is an enlarged view of the tab 126 with the shoulder for engagement with the retraction sub 120. In addition, the raised tabs 126 disposed in the pockets 127 allow transfer of torque in a manner similar to a spline assembly concept. In the run-in position, the shear sleeve 125 presses against the tabs 126 to prevent their disengagement from the pockets 127. To release the tabs 126, the shear sleeve 125 must be moved downward such that a circumferential recess 135 formed on the outer surface is positioned adjacent the tabs 126, thereby allowing the tabs 126 to deflect inward to disengage from the pockets 127. FIG. 6 is an enlarged view of the lower end of the upper telescoping casing 111. As shown, the upper telescoping casing 111 has an upwardly facing shoulder adapted to engage a downward facing shoulder of the retraction sub 120 when the assembly is subjected to tensile axial loading.

Figure 7:
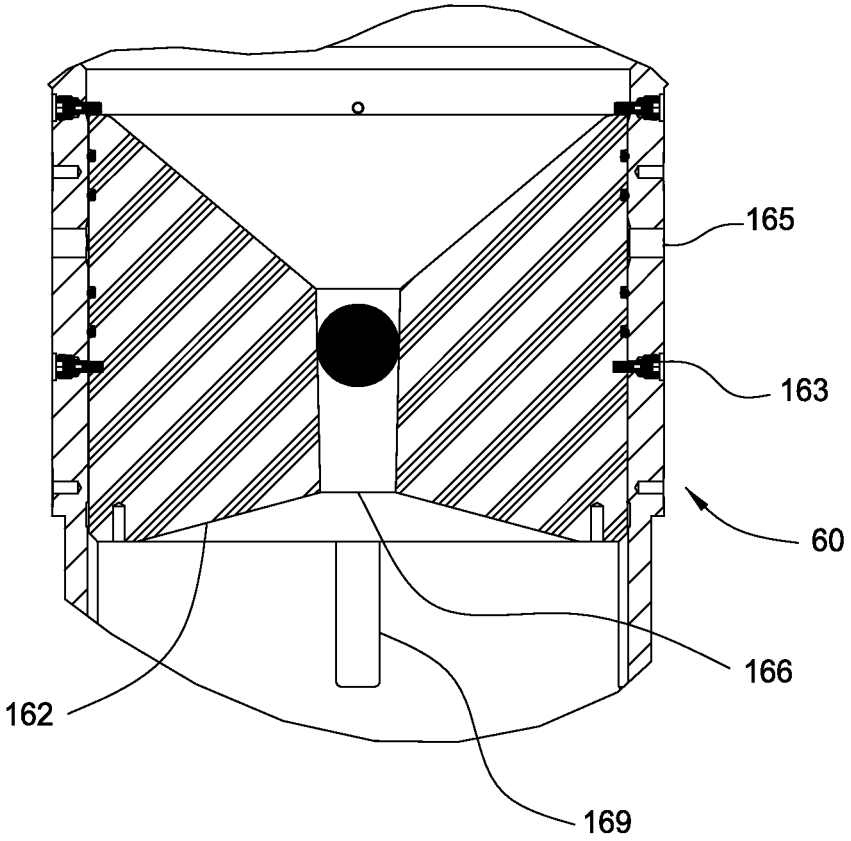
FIG. 7 shows an exemplary circulation sub suitable for use with the retractable joint in the unactivated position.

FIG. 7 shows an exemplary circulation sub 60 suitable for use with the retractable joint 50. The circulation sub 60 includes a circulation plug 162 releasably connected thereto using a shearable connection 163 such as a shear pin. In the run-in position, the circulation plug 162 blocks fluid communication through one or more ports 165 formed in the wall of the circulation sub 60. The circulation plug 162 may include a central bore having a seat 166 for receiving an activating device such as a ball. It must be noted that inclusion of the circulation sub is optional.

Figure 8:
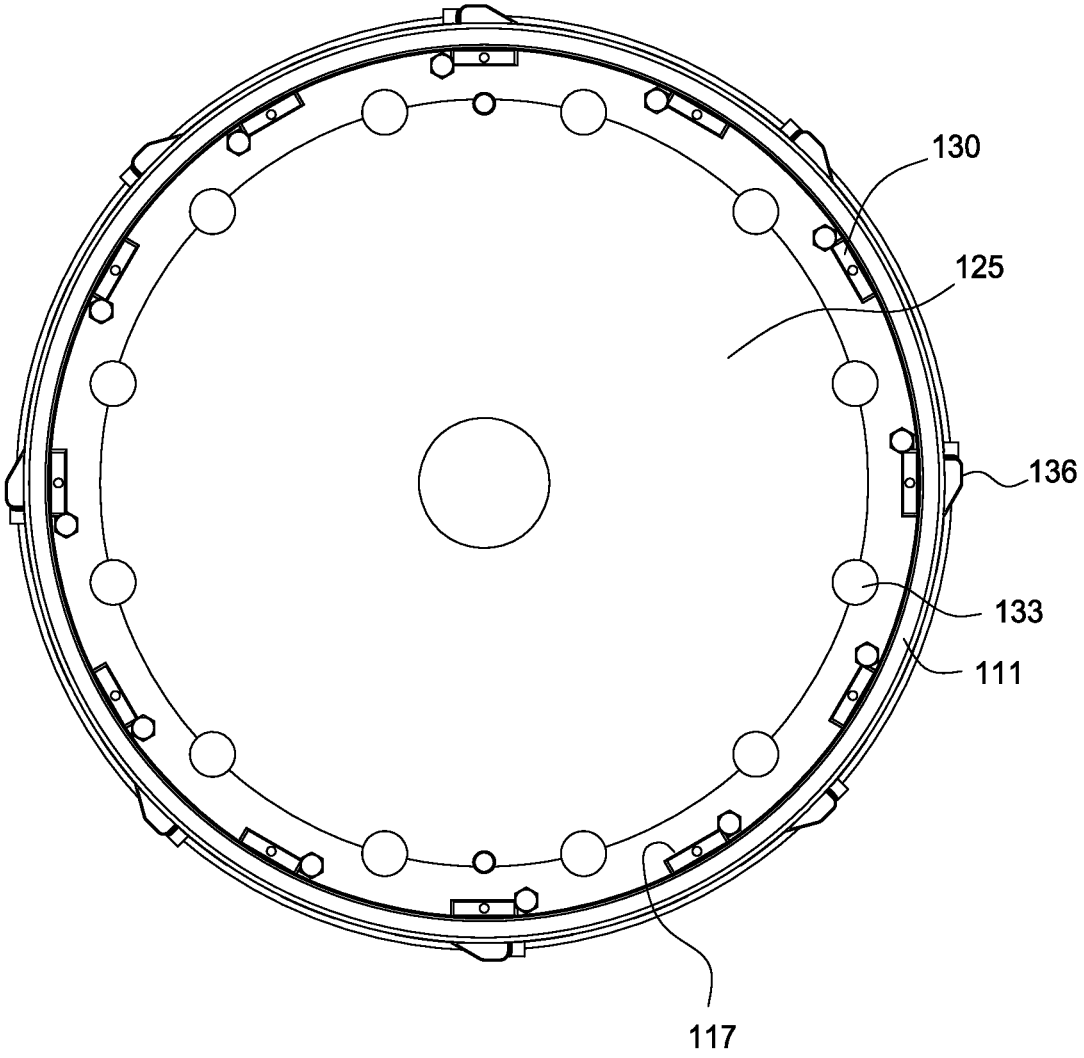
FIG. 8 is a cross-sectional view of the shear sleeve and the upper telescoping casing.
Figure 9B:
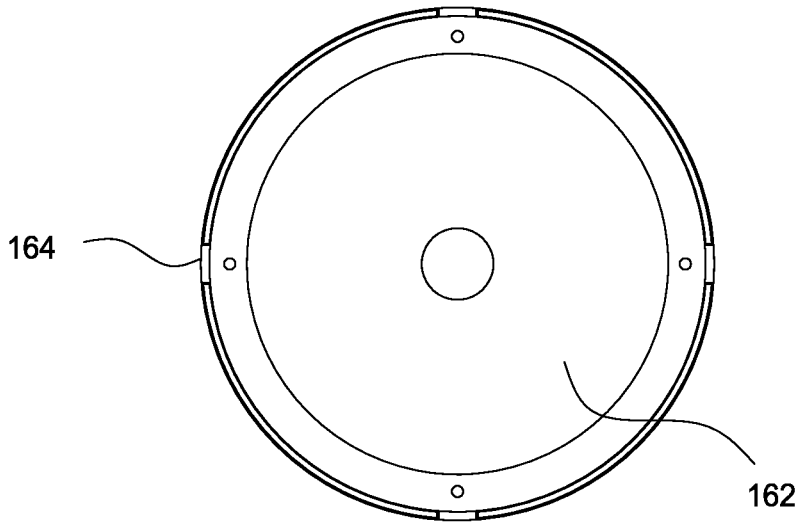
FIG. 9B is a bottom view of the circulation plug.
Figure 9A:
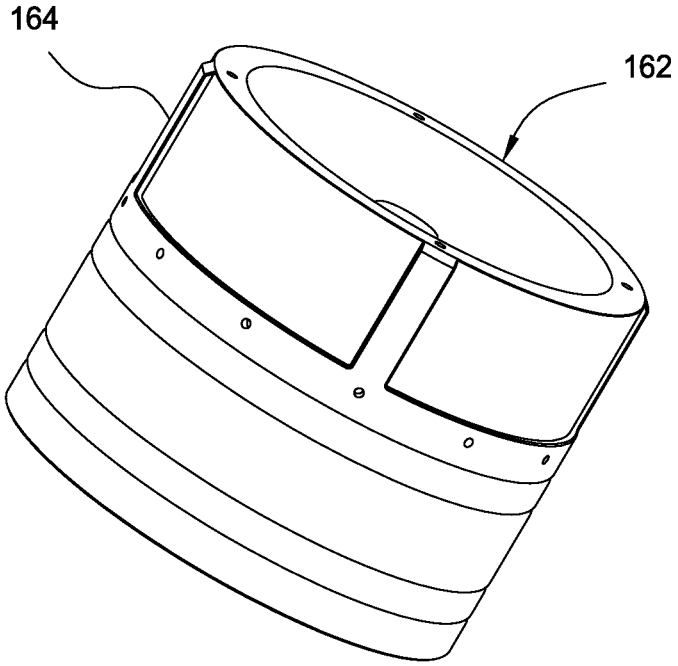
FIG. 9A is a perspective view of the circulation plug of the circulation sub.

The retractable joint may include features adapted to facilitate drill out of the shear sleeve 125, and if used, the circulation plug 162. FIG. 8 is a partial bottom view of the shear sleeve 125 and the upper telescoping casing 111. As discussed above, one or more keys 130 may be used to couple the two components 125, 111 and prevent relative rotation therebetween. As shown, keys 130 are disposed in a respective axial groove 117. It must be noted that any suitable number of keys may be used, for example, two, four, or six. Slips 136 may be used to provide anti-rotation between the upper telescoping casing 111 and the retraction sub 120. The slips 136 may be positioned in slip pockets 137 formed in the retraction sub 120, as shown in FIG. 4. Referring to FIGS. 9A-B, the circulation sub 60 uses keys to provide anti-rotation. The circulation plug 162 may includes keys 164 adapted to engage corresponding grooves 169 in the circulation sub 60. The grooves 169 are illustrated in FIG. 7. In this embodiment, the circulation sub uses four keys; however, any suitable number of keys may be used.

Figure 10:
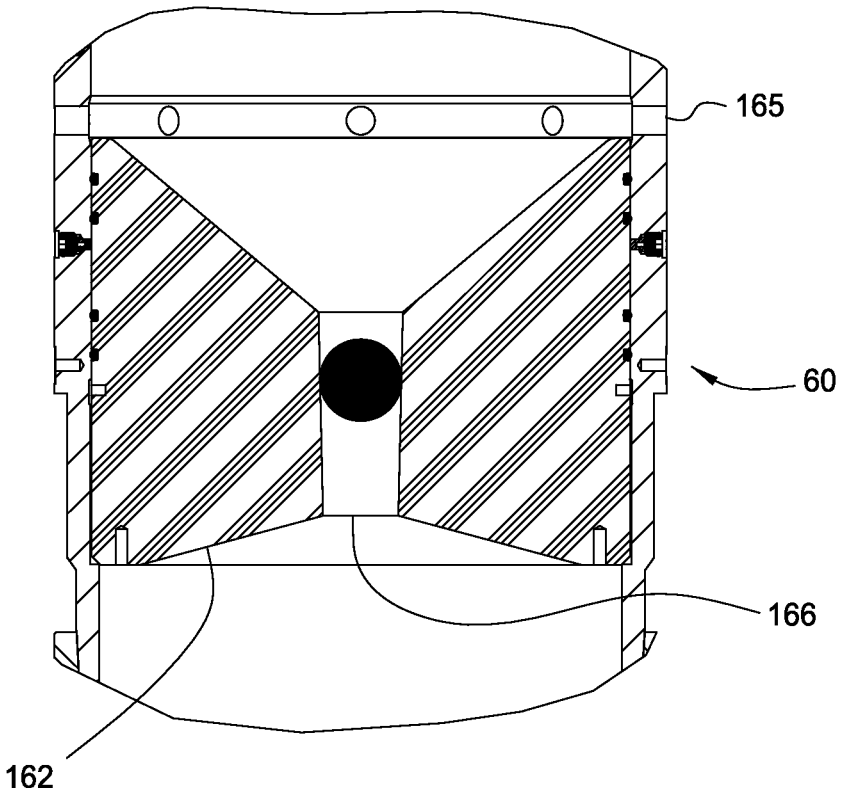
FIG. 10 shows the circulation sub of FIG. 7 in the activated position.

In operation, the retractable joint 50 with the optional circulation sub 60 may be activated using two activating devices, in this case, two balls. Initially, after the proper depth has been reached, the retractable joint 50 and earth removal member 25 are lifted off the bottom of the hole. A first ball is dropped and allowed to pass through the retraction sub 120 and land in the circulation plug 162, thereby closing the circulation path. Pressure is increased until the shear pins 163 are broken and the circulation plug 162 is freed to move downward to expose the circulation ports 165, as illustrated in FIG. 10.

Figure 11A:
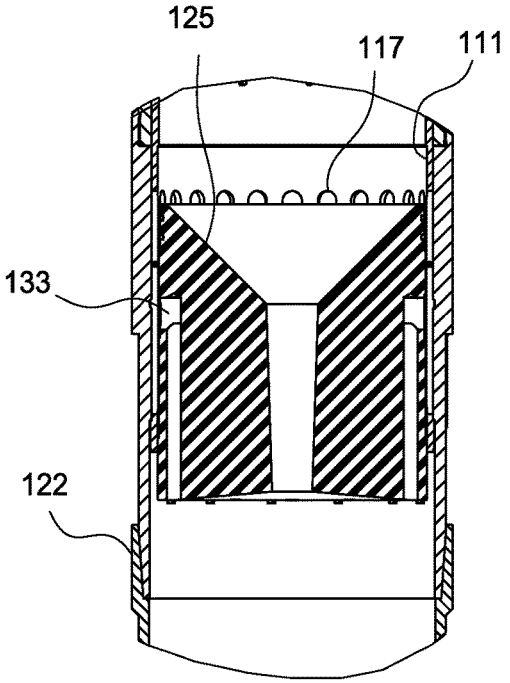
FIGS. 11A-B are different cross-sectional views of the telescoping portion in the activated position.
Figure 11B:
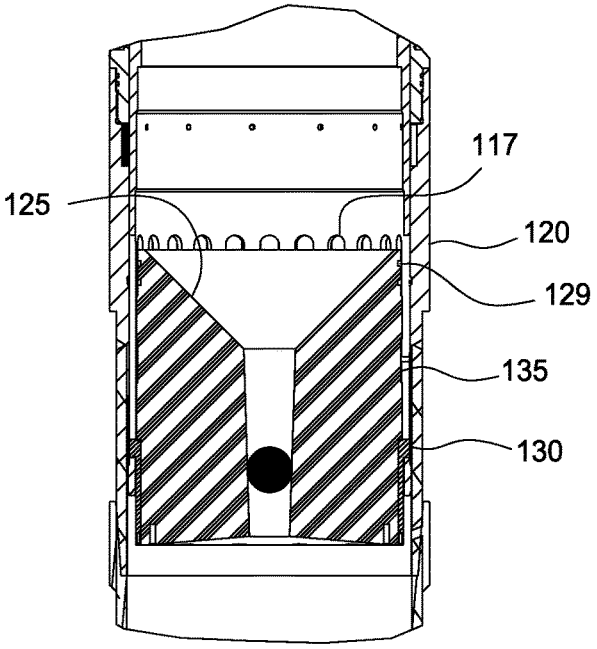
Figure 11C:
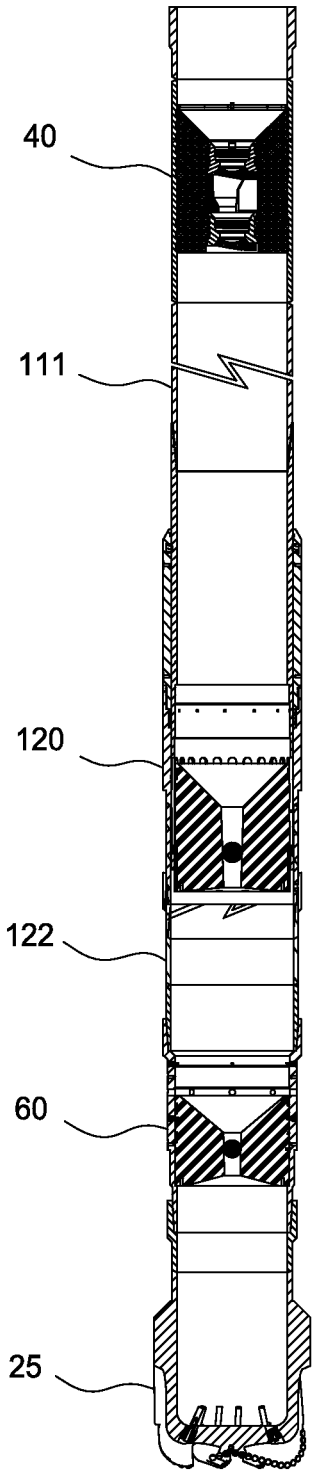
FIG. 11C shows the retractable joint in the retracted position.

A second, larger ball is dropped and allowed to land in the ball seat of the shear sleeve 125, which closes the circulation path. Pressure is increased until the shear pins 128 are broken and the shear sleeve 125 is freed to move downward relative to the upper telescoping casing 111. FIGS. 11A-B are different cross-sectional views of the telescoping portion in the activated position. Movement of the shear sleeve 125 is guided by the keys 130 traveling in the axial grooves 117 of the upper telescoping casing 111. The shear sleeve 125 moves downward until its top end is below the top of the axial grooves. Fluid may be circulated around the shear sleeve 125 by flowing into the axial grooves 117, then into the channels 133, and out of the bottom of the shear sleeve 125. Thereafter, the earth removal member 25 is returned to total depth and weight on bit is applied to retract the retractable joint 50. FIG. 11C shows the upper telescoping casing 111 retracted relative to the lower telescoping casing 122 and the retraction sub 120.

Figure 12A:
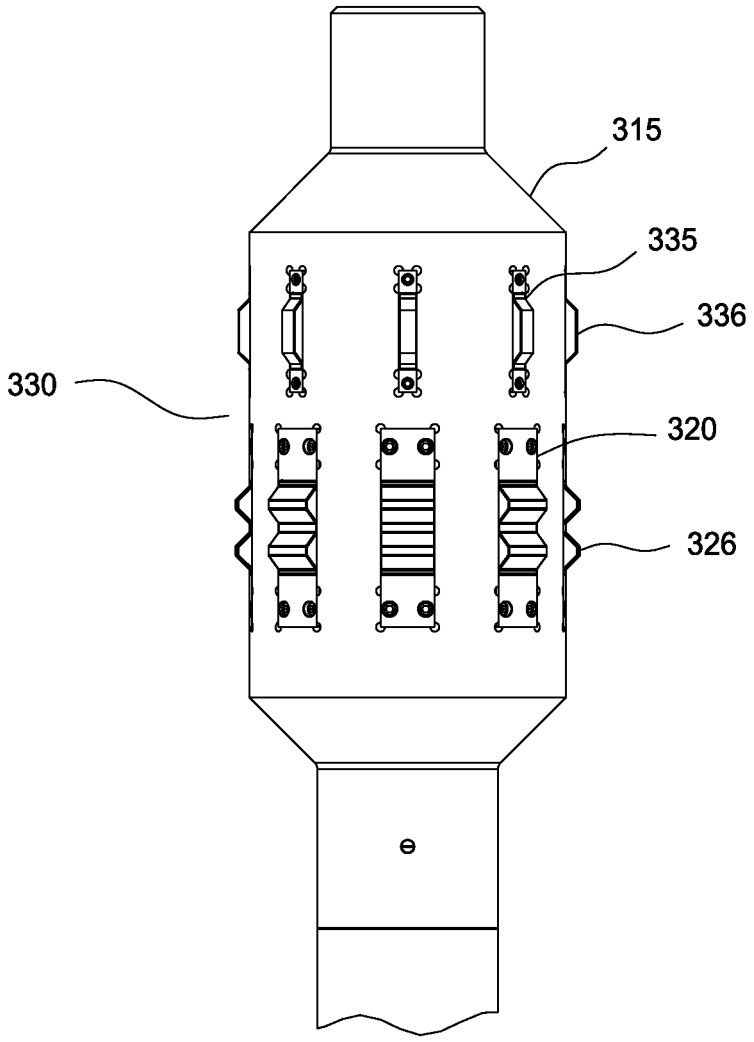
FIGS. 12A-C show an exemplary embodiment of a running tool and setting sleeve suitable for use with the drilling system.
Figure 12B:
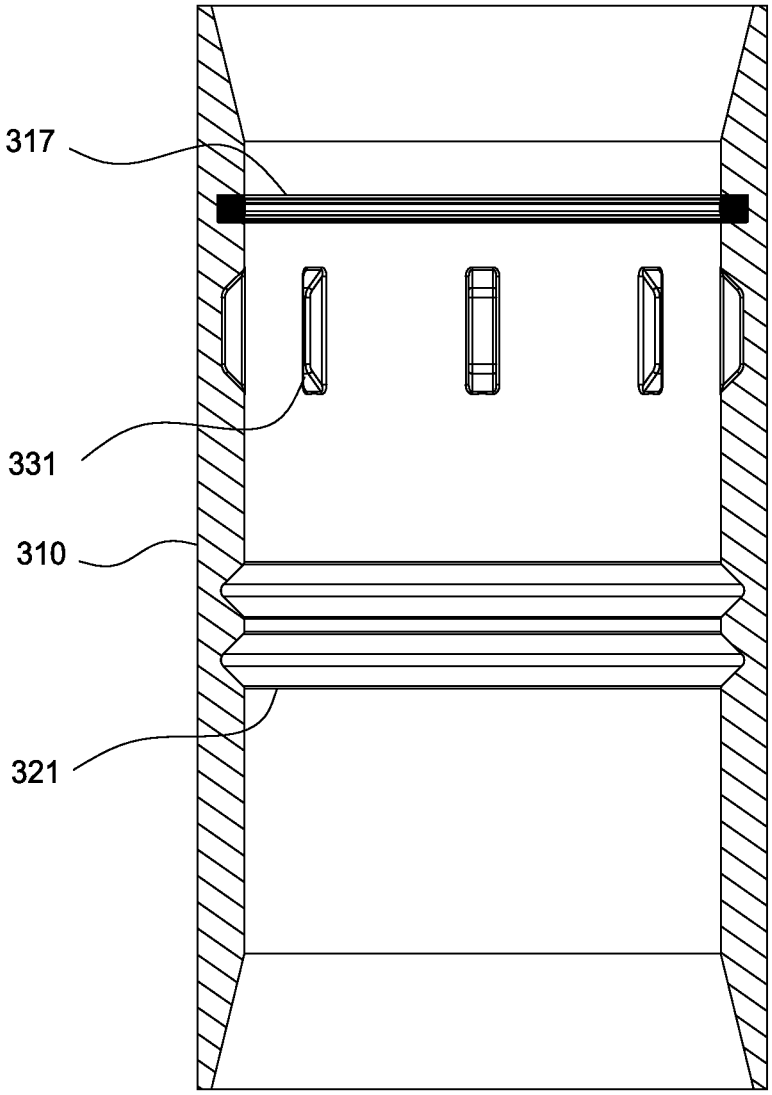
Figure 12C:
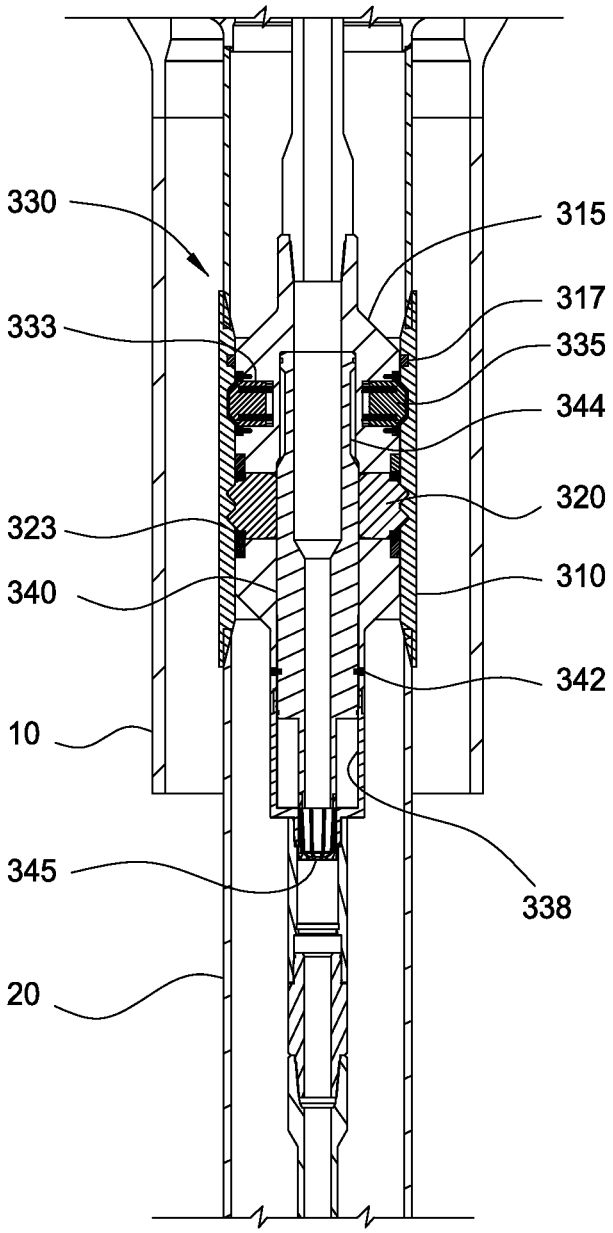

FIGS. 12A-C show an exemplary embodiment of a running tool 330 suitable for use with the drilling system 100. The running tool 330 is adapted to releasably engage a setting sleeve 310 connected to the casing string 20. One or more seals 317 may be positioned between the setting sleeve 310 and the running tool 330 to seal off the interface. In this embodiment, the seal 317 is located on the setting sleeve 310. The running tool 330 includes a running tool body 315 having one or more engagement members such dogs, clutch, or tabs. In one embodiment, the running tool 330 includes axial dogs 320 spaced circumferentially in the running tool body 315 for transferring axial forces to the setting sleeve 310. The axial dogs 320 may include one or more horizontally aligned teeth 326 that are adapted to engage an axial profile 321 such as a circular groove in the setting sleeve 310. The axial dogs 320 may be biased inwardly using a biasing member 323 such as a spring. The axial dogs 320 are retained in the locked position using an inner mandrel 340 disposed in the bore 338 of the running tool body 315. The running tool 330 may optionally include one or more torque dogs 335 spaced circumferentially in the running tool body 315 for transferring torque to the setting sleeve 310. The torque dogs 335 may include one or more axially aligned teeth 336 that are adapted to engage corresponding torque profiles 331 in the setting sleeve 310. The torque dogs 335 may be biased outwardly using a biasing member 333 such as a spring. It must be noted that the axial and torque dogs may be configured to be biased inwardly or outwardly. In one embodiment, the profiles of the teeth 326, 336 of the dogs 320, 335 may be configured to facilitate retraction. In one embodiment, the upper and lower ends of the teeth 326, 336 may be angled to facilitate retraction as the running tool 330 is moved axially. In the embodiment shown, the torque dogs 335 are positioned above the axial dogs 320. However, it must be noted that the axial dogs 320 may be positioned above the torque dogs 335; interspaced between one or more torque dogs; or positioned in any other suitable arrangement.

FIG. 12C shows the running tool 330 engaged with the setting sleeve 310. In this position, the inner mandrel 340 is positioned behind the axial dogs 320 to maintain engagement of the axial dogs to the axial profiles 321. The inner mandrel 340 is releasably connected to the running tool body 315 using a shearable connection such as shear pins 342. The upper end of the inner mandrel 340 has a recessed dog seat 344 formed around its outer surface. The lower end of the inner mandrel 340 has a collet 345 for receiving a ball or other activating device such as a dart or standing valve. In another embodiment, the lower end may include a ball seat or other suitable pressure activating device. In one example, the ball seat may be an expandable ball seat or a seat for an extrudable ball for passing the ball after activation.

Figure 13:
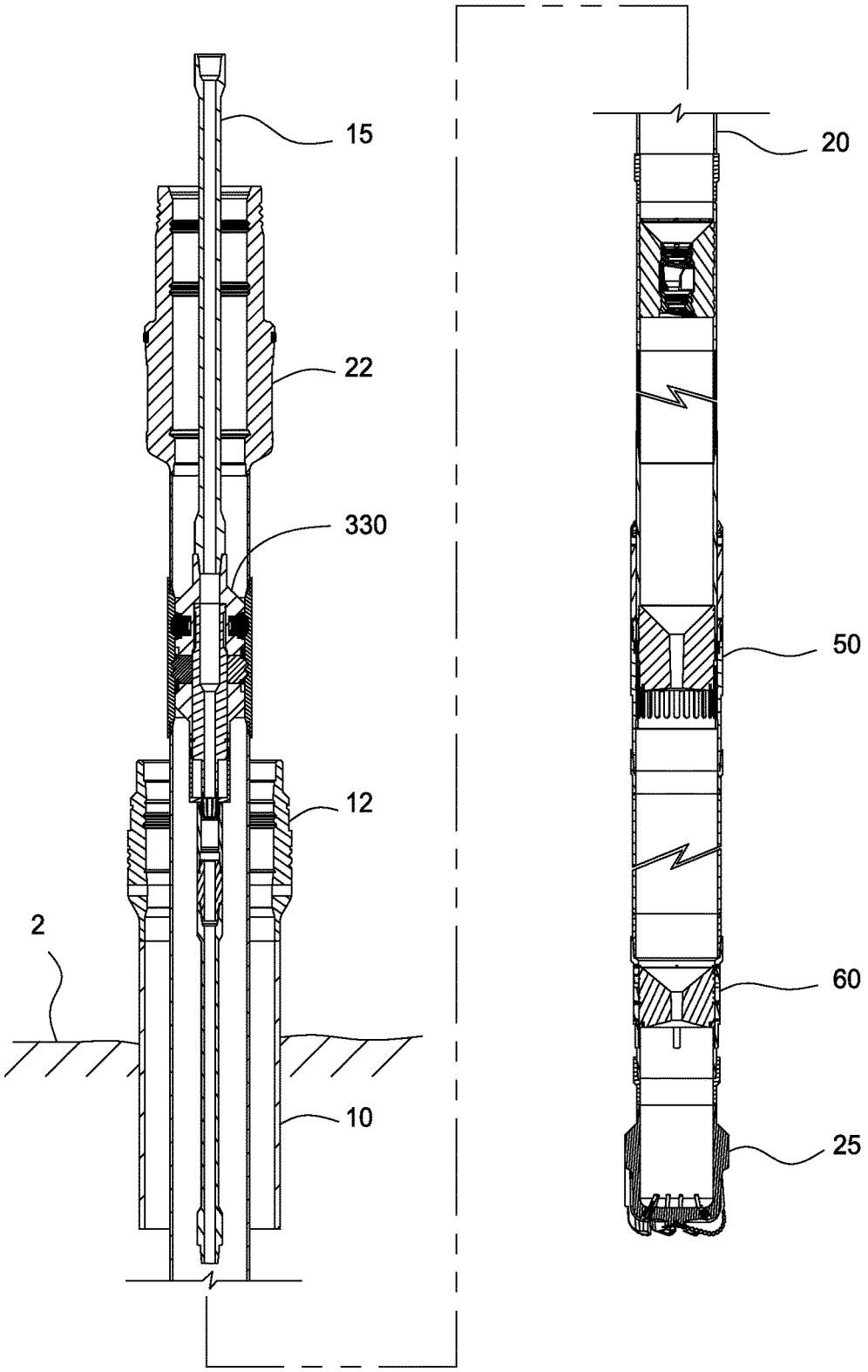
FIG. 13 shows an exemplary drilling system.

In operation, the running tool 330 may be used to convey a casing string 20 into the wellbore by engagement of the running tool 330 to the setting sleeve 310. The casing string 20 may include a retractable joint 50 and a circulation sub 60 as described above. Initially, a conductor pipe 10 equipped with a low pressure wellhead 12 is landed on the sea floor 2. A guide base may be used to support the conductor pipe 10 on the sea floor. The conductor pipe 10 is jetted and/or drilled into the sea floor to the desired depth. The conductor pipe 10 is allowed to "soak" or remain stationary until the formation re-settles around the conductor pipe 10 to support the conductor pipe 10 in position. Alternatively, the conductor pipe 10 may be cemented in position. Thereafter, the casing string 20 is coupled to the running tool 330 and conveyed into the conductor pipe 10 using a drill string 15, as shown in FIG. 13. The casing string 20 and the earth removal member 25 are then rotated to extend the wellbore.

Figure 14:
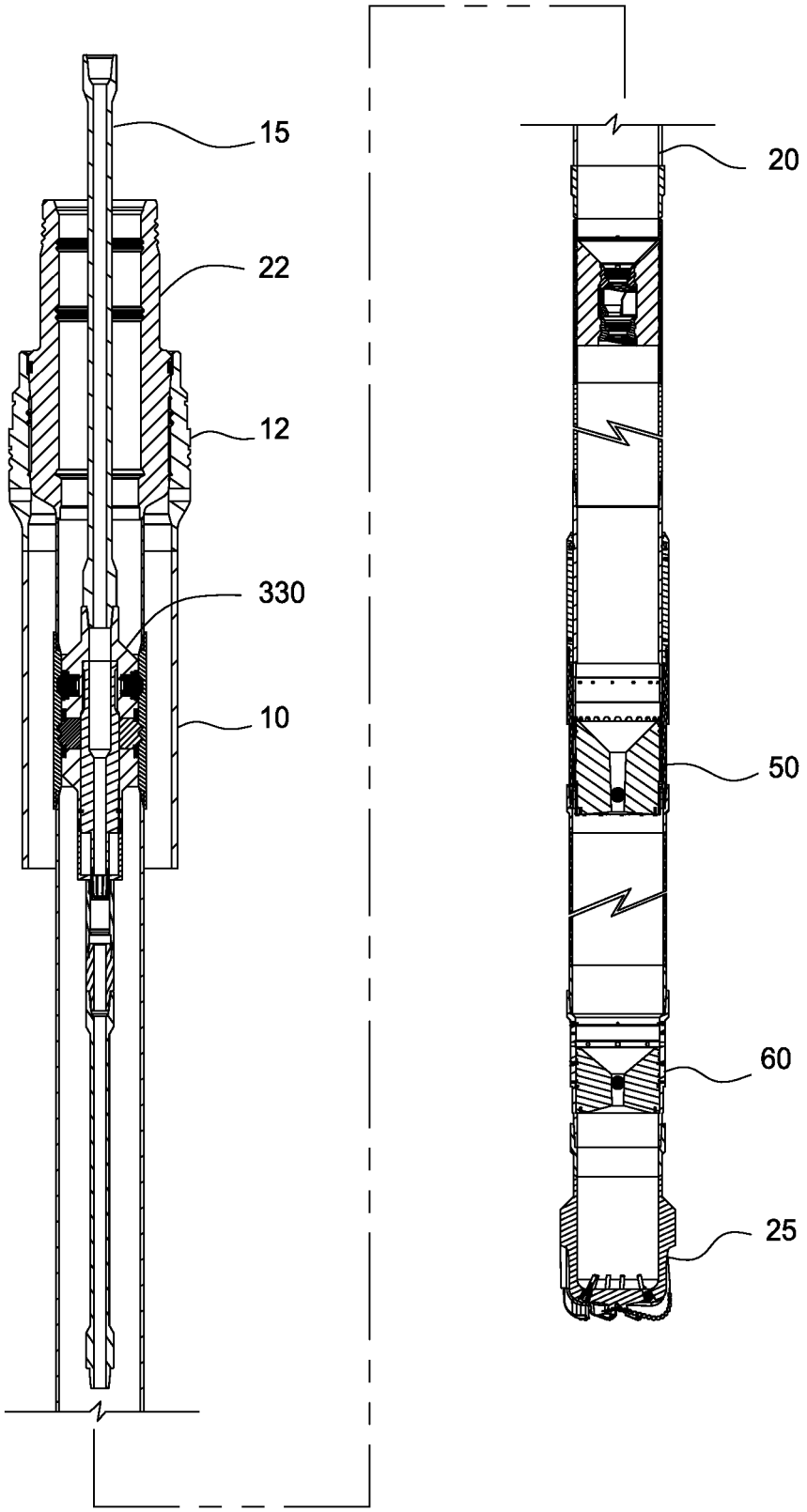
FIG. 14 shows the drilling system of FIG. 13 after the high pressure wellhead is landed in the low pressure wellhead.

In another embodiment, the conductor pipe 10 may be releasably attached to the casing string 20 and simultaneously positioned into the sea floor. After jetting the conductor pipe 10 into position, the formation is allowed to re-settle and support the conductor pipe 10. The casing string 20 is then released from the conductor pipe 10 and rotated to extend the wellbore. After drilling to the desired depth, a first ball is dropped to activate the circulation sub 60 and establish a fluid path through a side port in the circulation sub 60, as described previously with respect to FIG. 10. Then, a second ball is dropped to activate the retractable joint 50, as described previously with respect to FIGS. 3 and 11. An axial compressive load is applied to shorten the length of the casing string 20 through telescopic motion of the upper telescoping casing 111 and the lower telescoping casing 122 of the retractable joint 50 until the high pressure wellhead 22 has landed in the low pressure wellhead 12. FIG. 14 shows the lower portion of the casing string wherein the retractable joint has retracted and the side ports in the circulation sub 60 opened for fluid communication. FIG. 14 also shows the high pressure wellhead 22 landed in the low pressure wellhead 12.

Figure 15A:
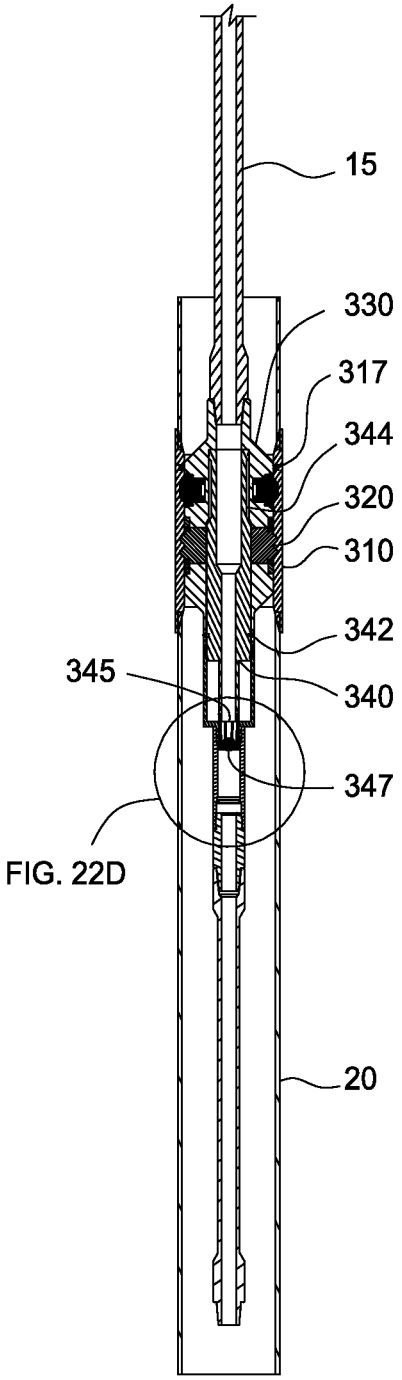
FIGS. 15A-F shows the sequential operation of the running tool in the drilling system of FIG. 13.
Figure 15D:
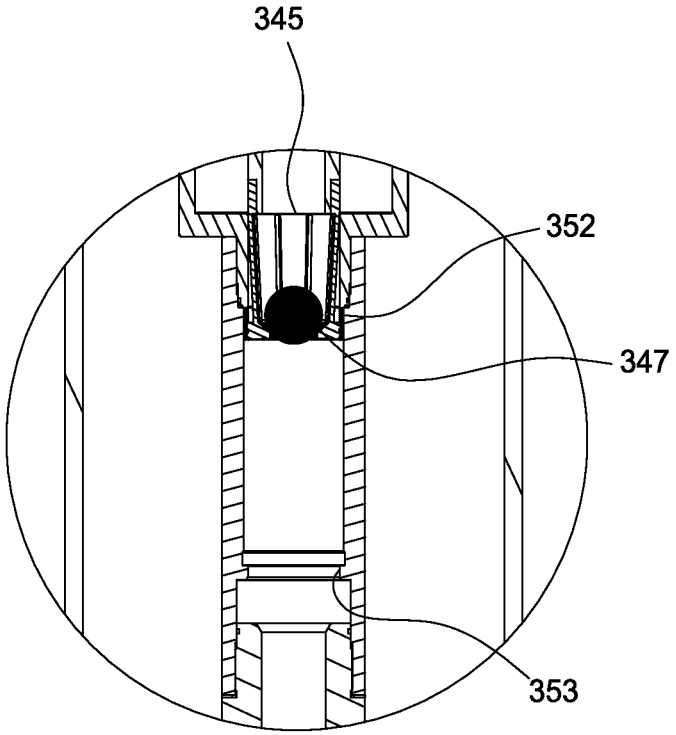
Figure 15B:
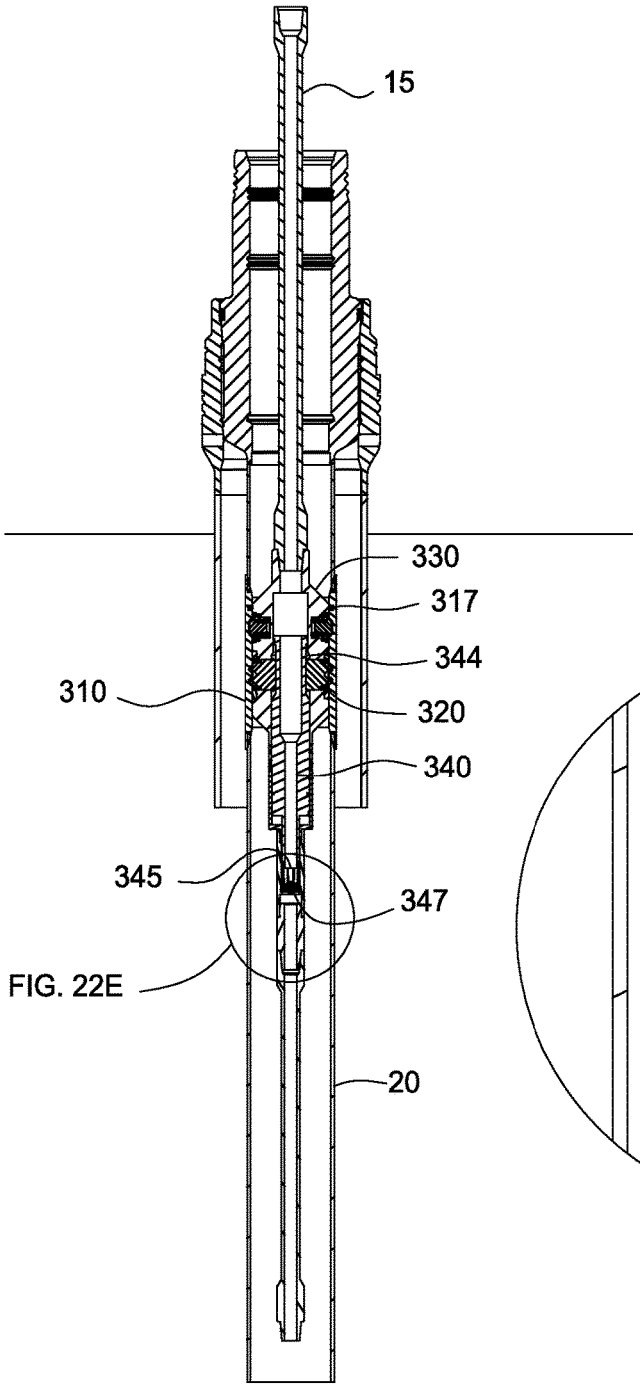
Figure 15E:
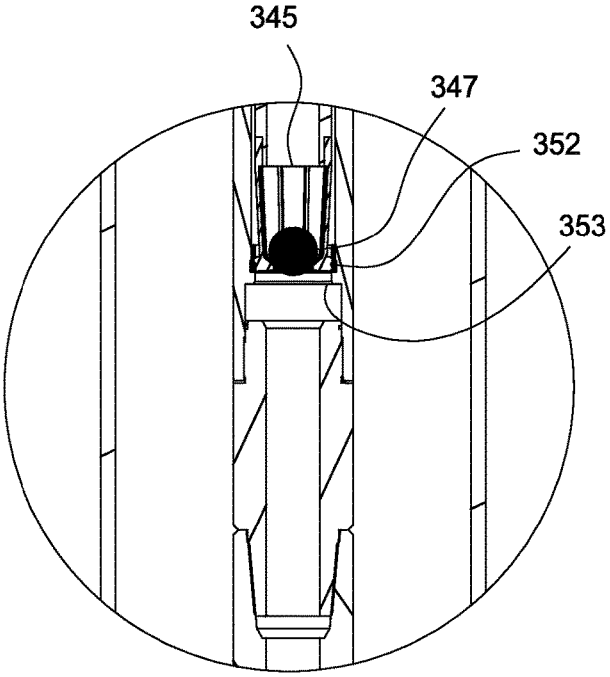
Figure 15C:
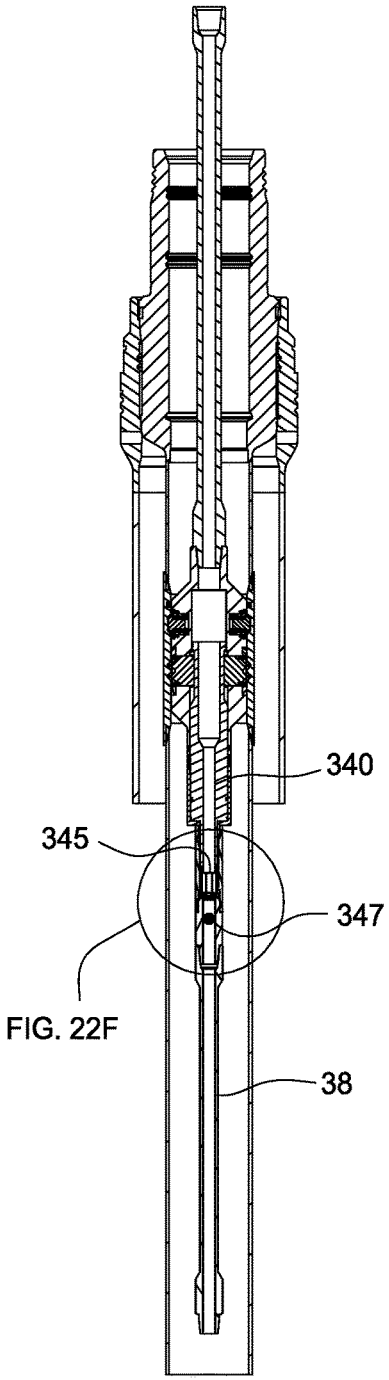
Figure 15F:
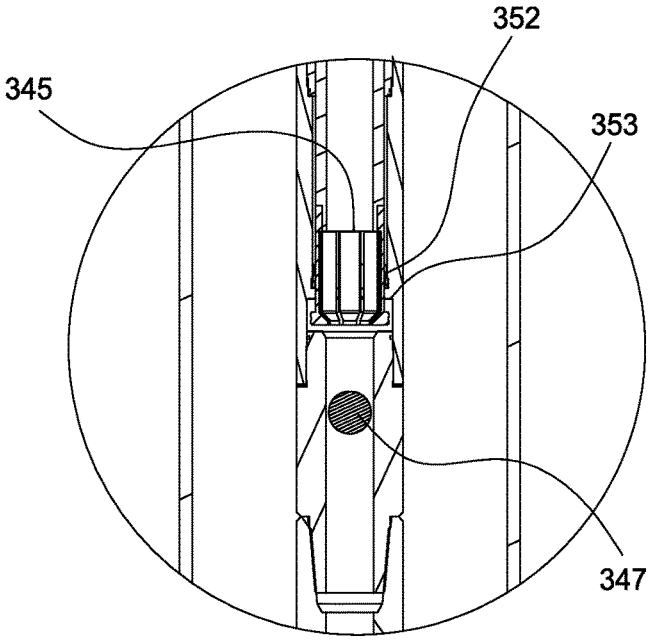
Figure 15G:
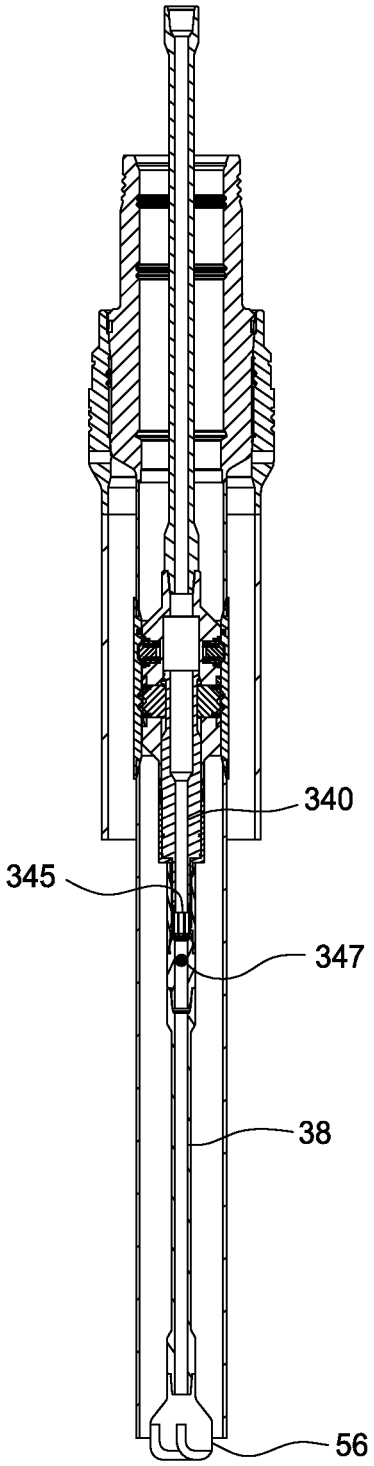
FIG. 15G shows another embodiment of a drilling system equipped with an earth removal member attached to an inner string.
Figure 16:
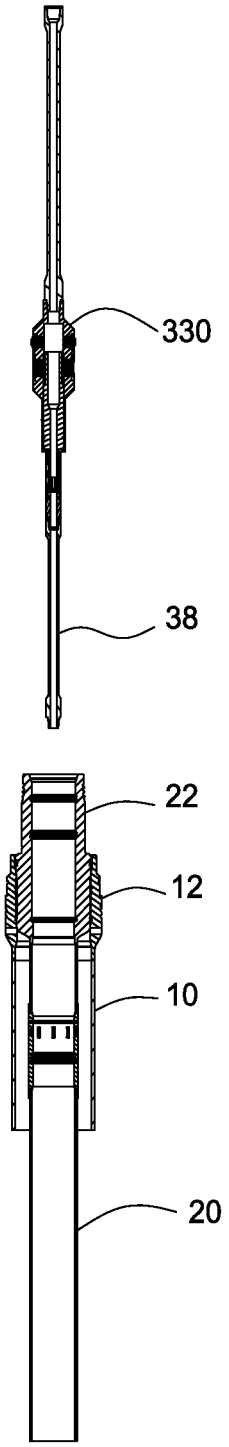
FIG. 16 shows the running tool pulled out of the casing string.

After landing the high pressure wellhead 22, the running tool 330 may be released from engagement with the casing string 20. Referring now to FIG. 15A, a ball 347 or other pressure activating device is dropped to land into the collet 345, ball seat or other pressure activating device to close the fluid path. In one embodiment, the collet 345 is disposed in a collet cap 352, as illustrated in FIG. 15D. The collet cap 352 has low friction exterior surfaces to facilitate movement along the inner surface of the bore. Pressure is increased to shear the pins 342 and allow the inner mandrel 340 to shift downward. The inner mandrel 340 moves downward until the recessed dog seats 344 are adjacent the axial dogs 320, thereby allowing the axial dogs 320 to disengage from the setting sleeve 310, as shown in FIG. 15B. The collet 345 and collet cap 352 are moved downward by the inner mandrel 340 until the collet cap 352 abuts a restriction 353 in the bore, as shown in FIG. 15E. Continued pressure causes the collet 345 to move out of the collet cap 352 and slide past the restriction 353 into an enlarged bore section. As shown in FIGS. 15C and 15F, the enlarged bore section allows the collet fingers to expand, thereby releasing the ball 347 from the collet 345. After disengagement, the running tool 330, along with any connected components such as an inner string, may be retrieved to surface. The casing string 20 may be cemented before or after the running tool 330 is retrieved. The cement may be supplied through the inner string 38. Alternatively, subsea release plugs, such as those described in U.S. Pat. No. 5,553,667, which is incorporated herein by reference, may be used for cementing with or without the inner string 38. FIG. 16 shows the running tool 330 and the attached inner string pulled out of the casing string 20. In addition, the casing string 20 has been disposed inside the conductor casing 10 and the high pressure wellhead 22 has landed in the low pressure wellhead 12. In another embodiment, the inner string 38 may be equipped with an earth removal member 56 prior to run-in, as illustrated in FIG. 15G. After releasing the running tool 330, the drill string 15 may be used to drill ahead by rotating the earth removal member 56.

Figure 17:
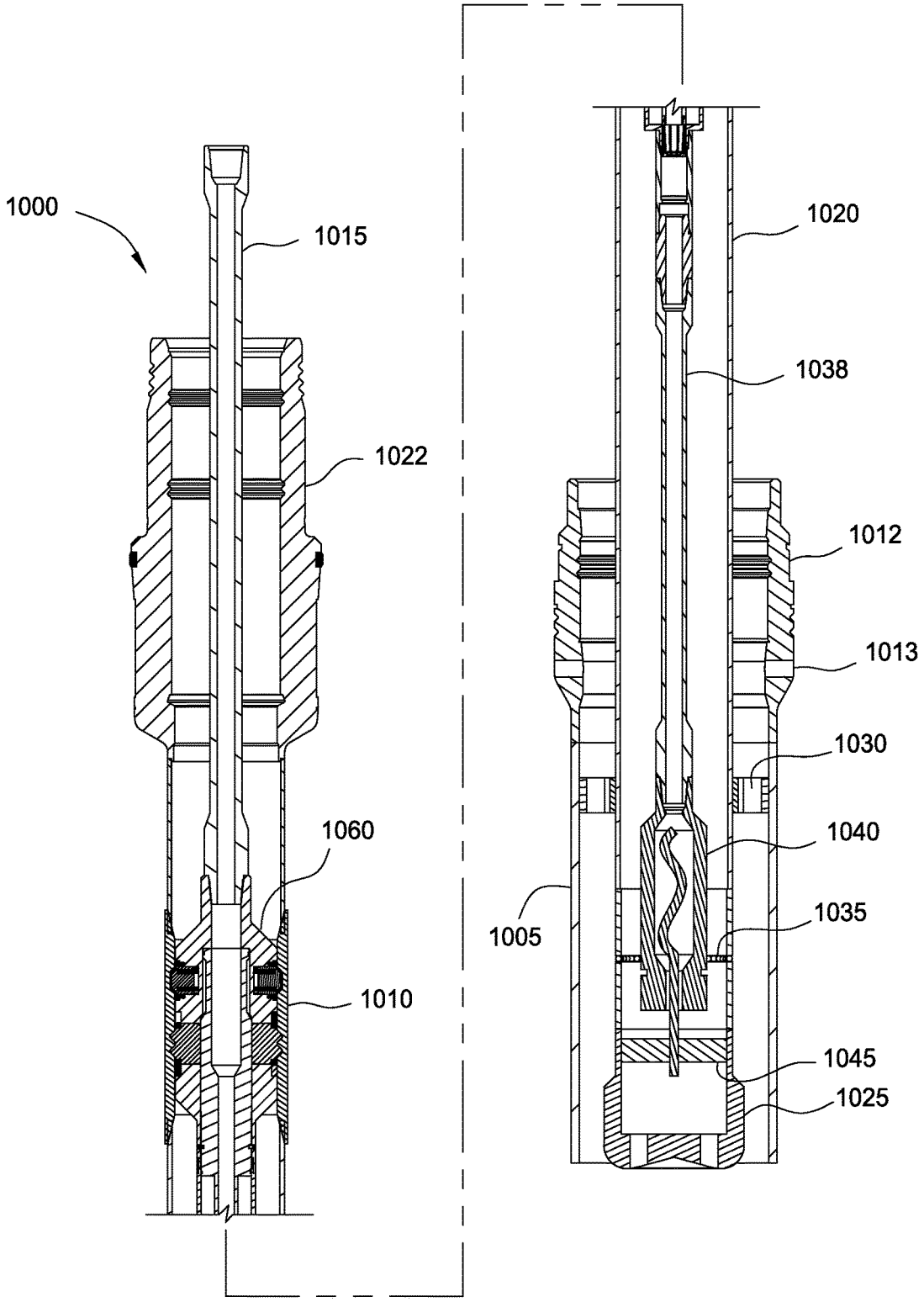
FIG. 17 illustrates another embodiment of a drilling system for subsea drilling with casing.

FIG. 17 illustrates another embodiment of a drilling system 1000 for subsea drilling with casing. The drilling system 1000 includes a casing string 1020 coupled to a drill string 1015 using a running tool 1060. The running tool 1060 may be selected from any suitable running tool, for example, the running tool disclosed in FIG. 12; or known to a person of ordinary skill in the art. The running tool 1060 may be coupled to a setting sleeve 1010 installed on the casing string 1020. The casing string 1020 may include a high pressure wellhead 1022 at its upper end and an earth removal member 1025 at its lower end. A conductor 1005 having a low pressure wellhead 1012 is releasably coupled to the casing string 1020 using a latch 1030 such as a mechanical latch. An exemplary latch is a J-latch. In this respect, the conductor 1005 and the casing string 1020 may be run-in together in a single trip. The conductor 1005 may optionally include a guide base.

Figure 18A:
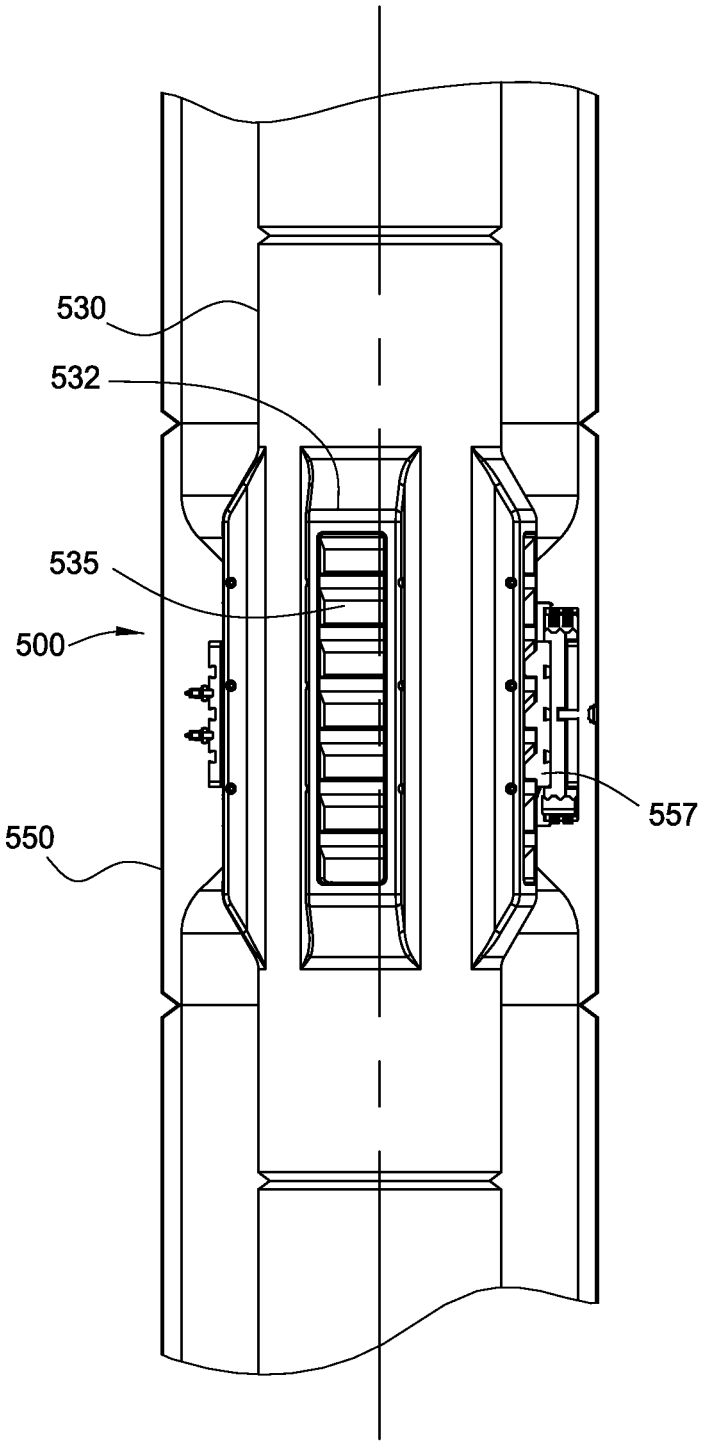
FIGS. 18 and 18A illustrate an exemplary embodiment of a latch assembly for coupling two strings of tubulars.
Figure 18:
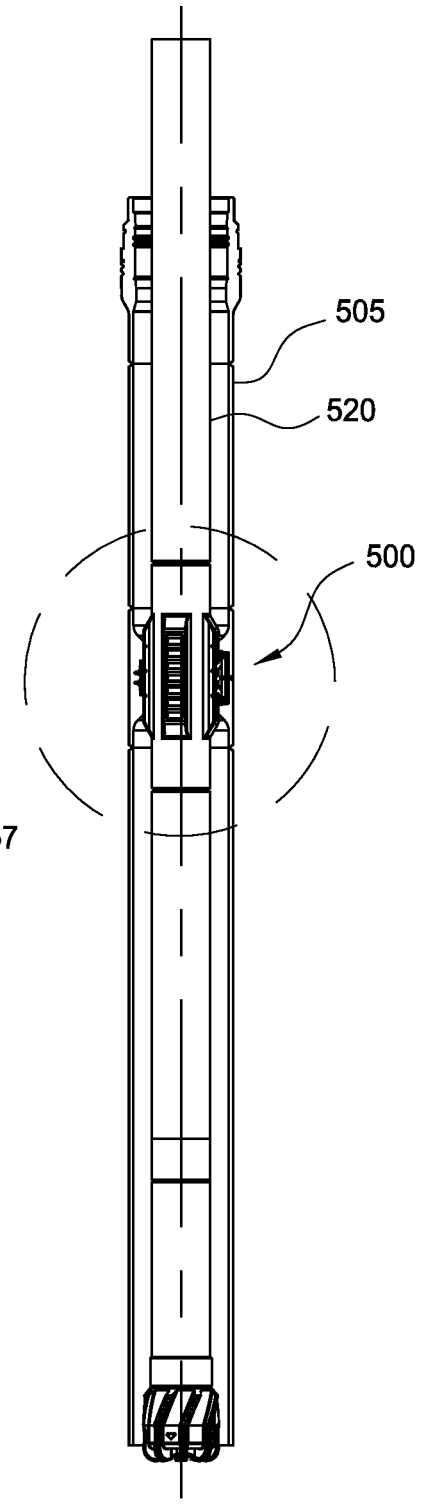
Figure 19:
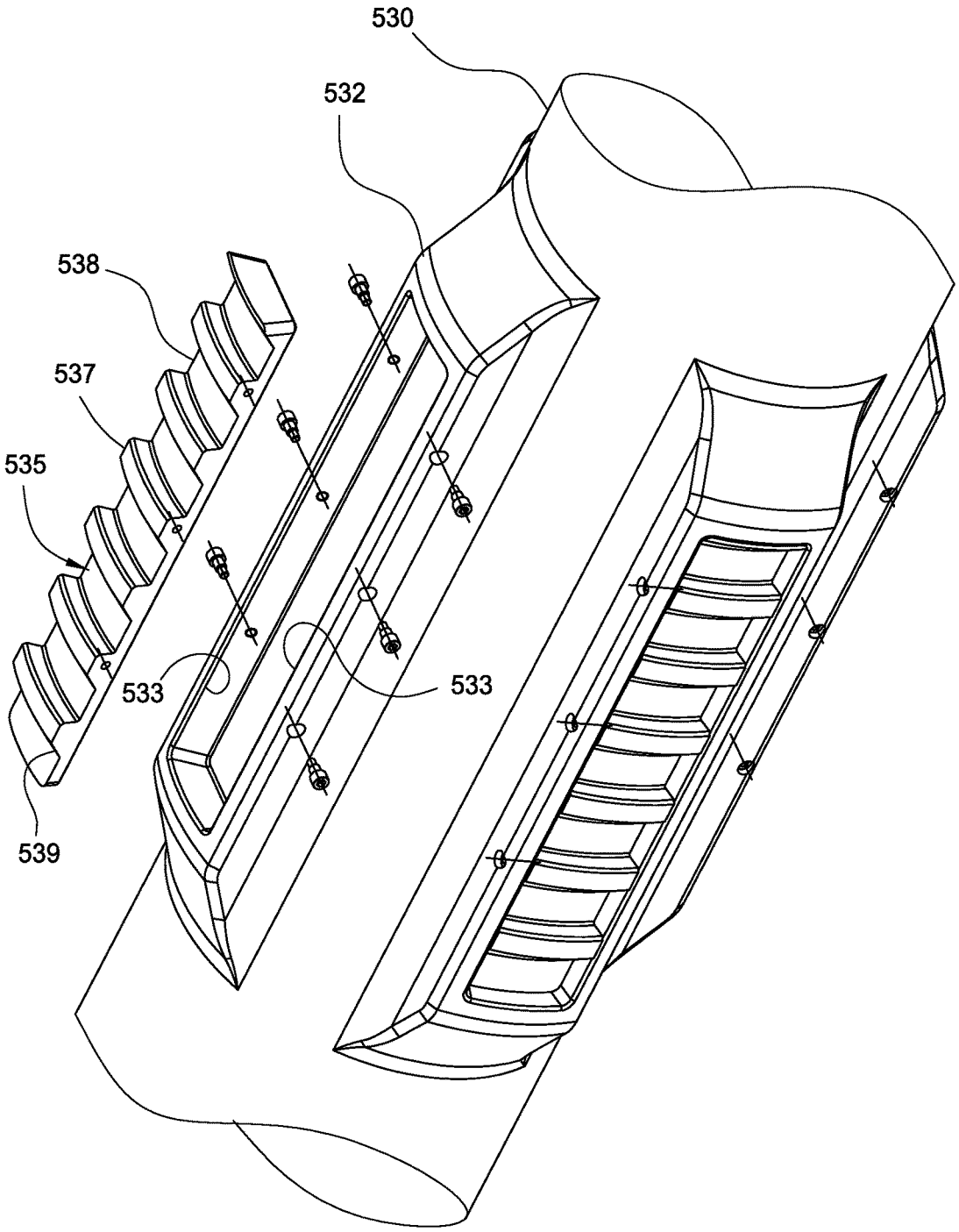
FIG. 19 is an enlarged, partial view of the latch mandrel of the latch assembly of FIG. 18

FIG. 18 illustrates another embodiment of a latch assembly 500 for coupling two tubulars such as a conductor 505 and a casing 520. As shown, the casing 520 is disposed in the conductor 505. FIG. 18A is a partial enlarged view of the latch assembly 500 in FIG. 18. The latch assembly 500 includes a latch mandrel 530 connected to the casing 520. In another embodiment, the latch mandrel 530 may be integral with the casing 520. As shown in FIG. 19, the latch mandrel 530 includes one or more key retainers 532 for retaining a plurality of mandrel keys 537. In another embodiment, the keys 537 may be attached directly to the mandrel 530. The keys 537 may be formed on a key support 535, which may be inserted in and attached to the key retainers 532. The key support 535 may be attached using a pin, bolt, screw, or any other suitable attachment member or mechanism such as welding. The plurality of keys 537 are axially spaced such that key slots 538 are formed between each key 537. The key retainers 532 may include walls 533 on each side of the keys 537 and key slots 538. In one embodiment, the lower surface of the mandrel keys 537 has a downward incline 539.

Figure 20:
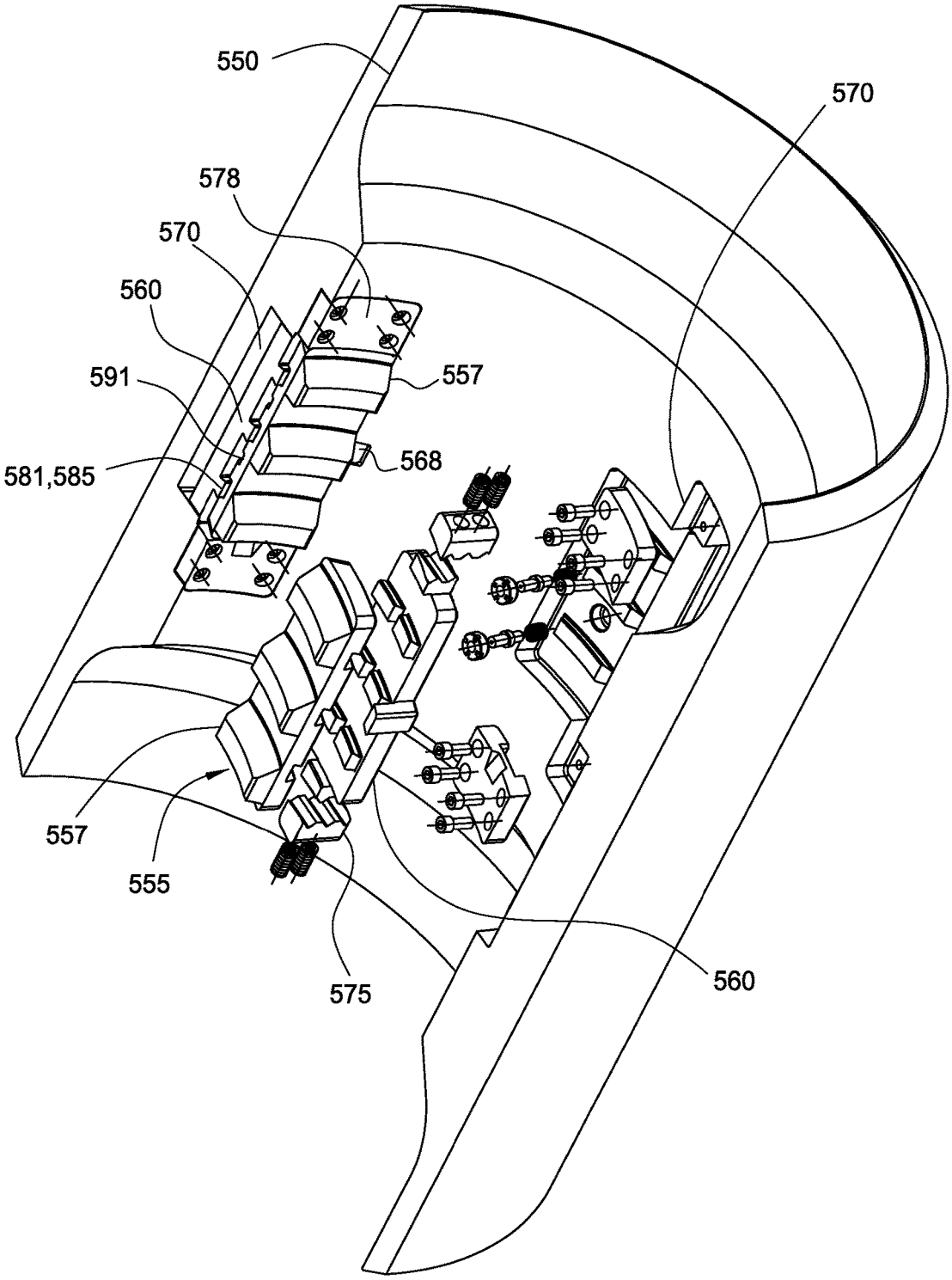
FIGS. 20 and 20A-C are enlarged, partial views of the latch housing of the latch assembly of FIG. 18.
Figure 20A:
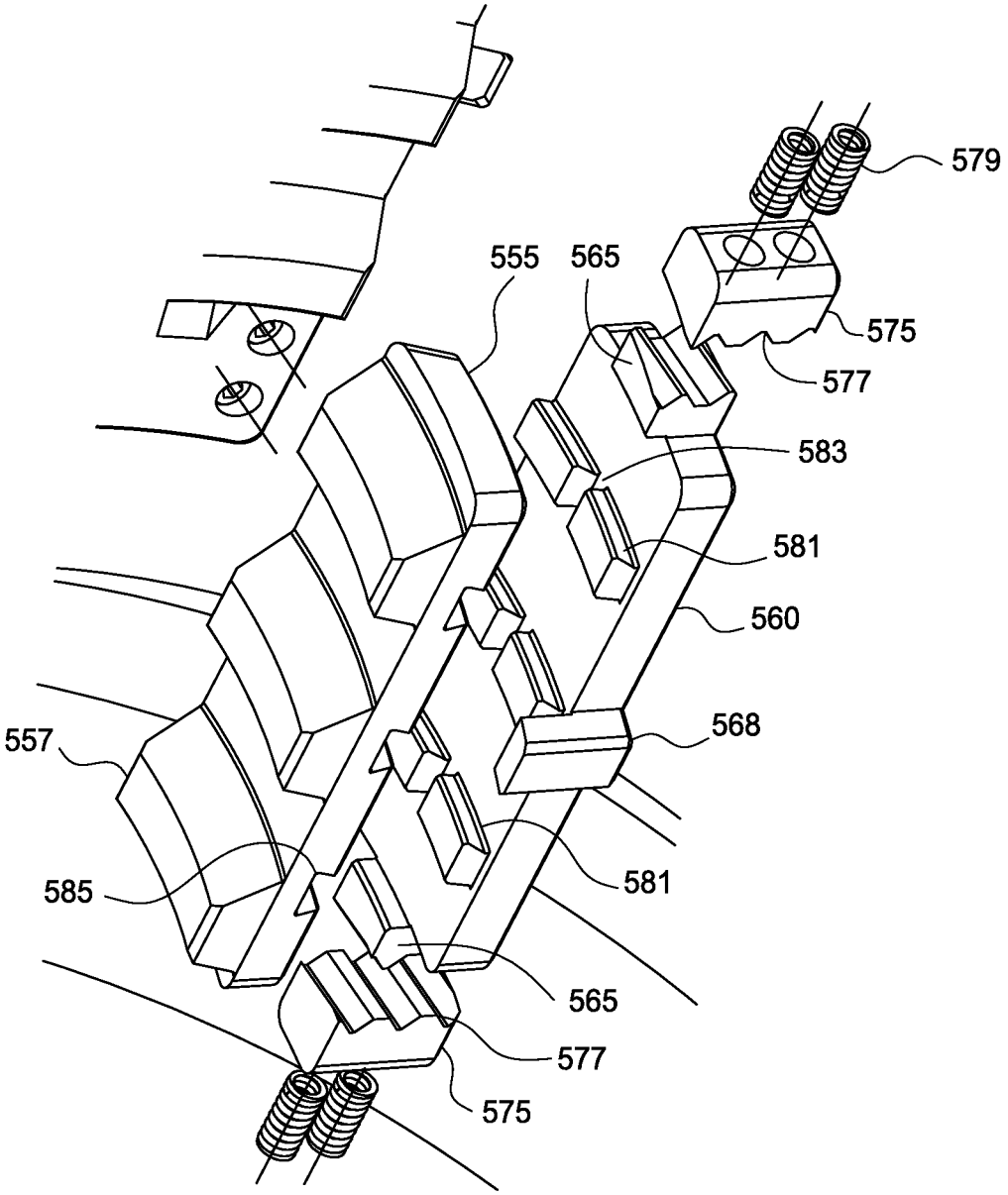
Figure 20C:
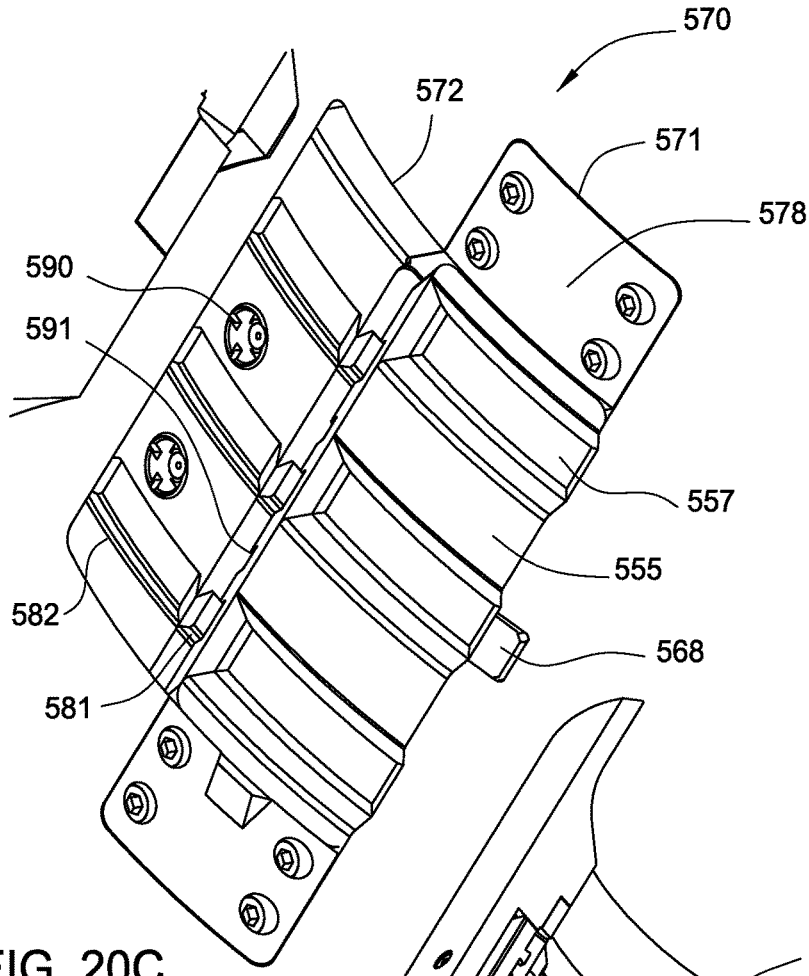
Figure 20B:
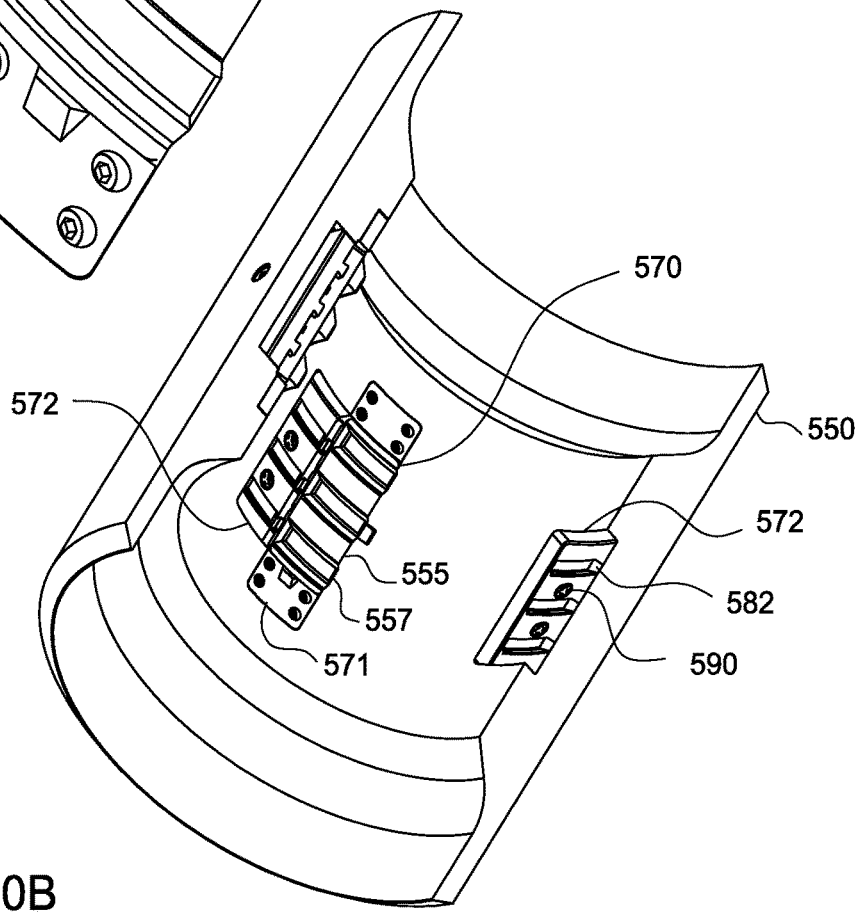
Figure 21:
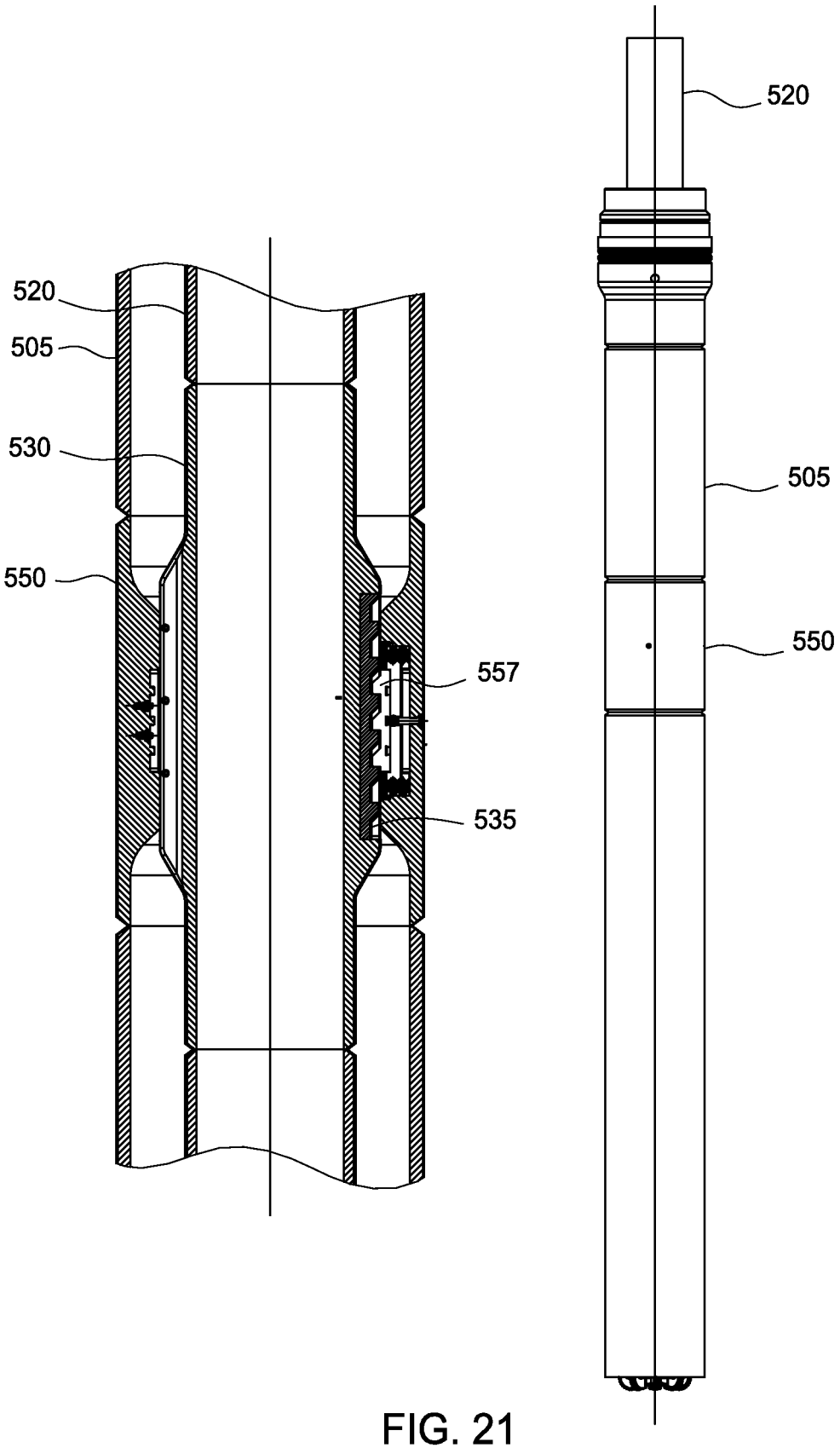
FIG. 21 is a partial cross-sectional view of the latch assembly of FIG. 18.

The latch assembly 500 also includes a latch housing 550 connected to the conductor 505. In another embodiment, the latch housing 550 may be integral with the conductor 505. As shown in FIGS. 20, 20A, 20B, and 20C, the latch housing 550 includes one or more latch keys 557 for mating with the keys 537 of the latch mandrel 530. The latch keys 557 may be formed on a latch key support 555, which is disposed in a pocket 570. The latch keys 557 are movable in the pocket 570 from a retracted position to an extended position for engagement with the mandrel keys 537. FIGS. 20 and 20A-C show the latch keys 557 in the extended position. The latch keys 557 are optionally coupled to an elevator 560, which may be used to extend or retract the latch keys 557. In one embodiment, the latch support 555 is coupled to the elevator 560 using a dovetail connection. As shown in FIG. 20A, the backside of the latch support 555 includes grooves 585 for mating with the dovetails 581 on the elevator 560. In one embodiment, one or more channels 583 may be formed between two adjacent dovetails 581 to facilitate the flow of fluids, solids such as mud, or both. FIG. 21 illustrates a partial cross-sectional view of the latch assembly of FIG. 20.

In one embodiment, a ratchet 575 is used to control movement of elevator 560. A ratchet 575 is positioned in the pocket 570 at locations above and below the elevator 560. The ratchets 575 includes tracks 577 for mating with the mating ratchet 565 on the elevator 560. One or more biasing members such as a spring 579 are used to bias the ratchet 575 toward the mating ratchet 565. In this embodiment, the biasing members bias the ratchet 575 in the axial direction toward the mating ratchet 565. An optional cover 578 may be used to retain the ratchet 575 in the pocket 570. The elevator 560 may optionally include a moving guide 568 to facilitate its movement between the retracted and the extended positions.

The latch keys 557 are configured to move between an unlocked position and a locked position in the pocket 570 of the latch housing 550. As shown in FIG. 20B, the latch keys 557 are in the unlocked position when they are on the right side 571 of the pocket 570. As will be described herein, the latch keys 557 are in the locked position when they are moved to the left side 572 of the pocket 570. When the latch keys 557 are on the right side 571 of the pocket 570, the keys are allowed to extend or retract in the pocket 570 as discussed above. The left side 572 of the pocket 570 includes dovetails 582 that are configured to mate with grooves 585 of the latch support 555 as the latch support 555 moves to the left side 572. As shown, the dovetails 582 on the left side 572 are aligned with the dovetails 581 on the right side 571. The left side 572 may optionally include one or more shearable members such as a pin 590. The pin 590 may be biased outwardly toward the elevator 560. The back of the latch key 557 may include a hole for receiving the pin 590. In another embodiment, the left side of the latch key 557 may include an incline 591 to retract the pin 590 as the latch key 557 moves to the left. The pin 590 is allowed to be biased outwardly when the hole is aligned with the pin 590.

Referring back to FIG. 17, the drilling system 1000 includes a downhole drilling motor 1040 to rotate the earth removal member 1025. Exemplary drilling motors includes a mud motor, a positive displacement motor, a hollow shaft drilling motor, a drillable motor, turbine, and other suitable motors known to a person of ordinary skill in the art. An exemplary hollow shaft drilling motor is disclosed in U.S. Pat. No. 7,334,650, issued to Giroux et al., on Feb. 26, 2008. The description with respect to the hollow shaft drilling motor is incorporated herein by reference. An inner string 1038 may be used to couple the motor 1040 to the running tool 1060 and the drill string 1015. A motor coupling 1045 may be used to releasably couple the drilling motor to the earth removal member 1025. The motor coupling 1045 is adapted to transfer torque from the output shaft of the drilling motor 1040 to the earth removal member 1025. An exemplary motor coupling 1045 is a motor latch or a spline connection in which the output shaft may be inserted into the motor coupling 1045. The earth removal member 1025 may be rotatably coupled to the casing string 1020 using a swivel 1035 having bearings or a ball joint located above the motor coupling 1045. The bearings or ball joint may be used to transfer drilling loads. In another embodiment, the motor bearings of the drilling motor 1040 are configured to carry the drilling loads. In this respect, the swivel 1035 only needs to provide a rotating sealing function.

Figure 22A:
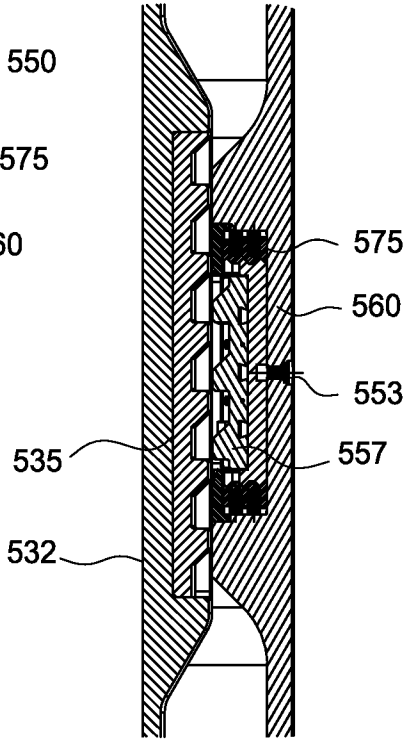
FIGS. 22A-D, 23A-C, 24A-B, and 25A-B are sequential views of assembling the latch mandrel to the latch housing of the latch assembly of FIG. 18.
Figure 22C:
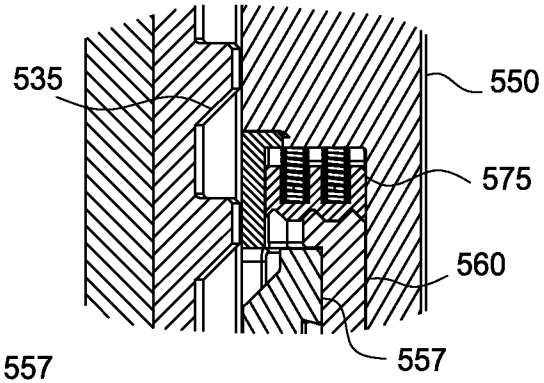
Figure 22D:
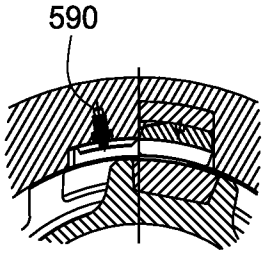
Figure 22B:
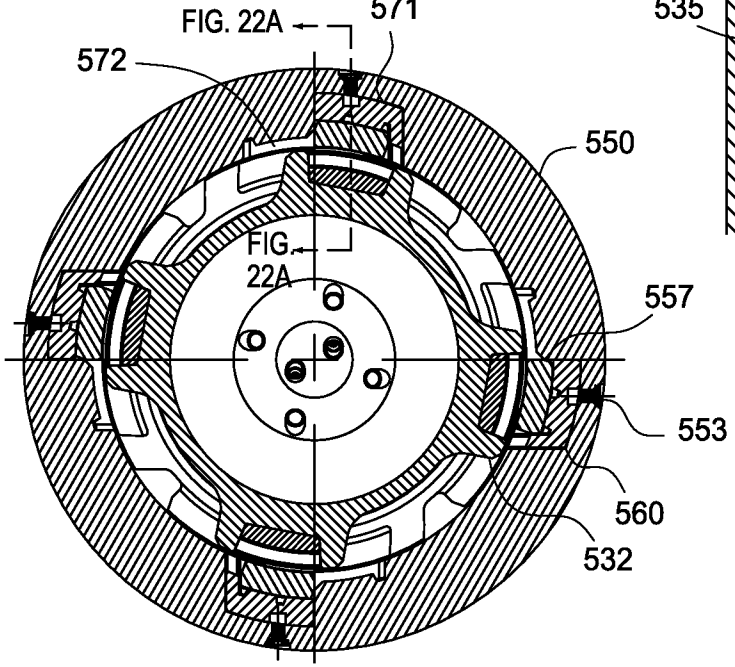

The drilling system 1000 is assembled by coupling the casing string 1020 to the conductor 1005 using the latch assembly 500. Initially, the conductor 1005 is held by a rig while the casing string 1020 is made up inside the conductor 1005. After the appropriate length of casing 1020 has been connected, the latch mandrel 530 is positioned adjacent latch housing 550 of the conductor 1005. FIGS. 22A-D are different cross-sectional views of the latch assembly 500. As shown, the elevator 560 and the keys 557 are in the retracted position and ready to engage the mating keys 537 of the casing string 1020. The elevator 560 is held in the retracted position by the ratchet 575 as shown in the enlarged view of FIG. 22C. In this position, the elevator 560 is engaged with the lower track 577 on the ratchet 575. FIG. 22D shows the shear pin 590 biased outwardly. A sealed cap screw 553 is initially used to seal an opening behind the elevator 560. In another embodiment, the mating key support 535 may have a length that is longer than the latch key support 555. The longer length allows the offset between the bit at the lower end of the casing string 1020 and the bottom of the conductor 1005 to be adjusted as necessary.

Figure 23A:
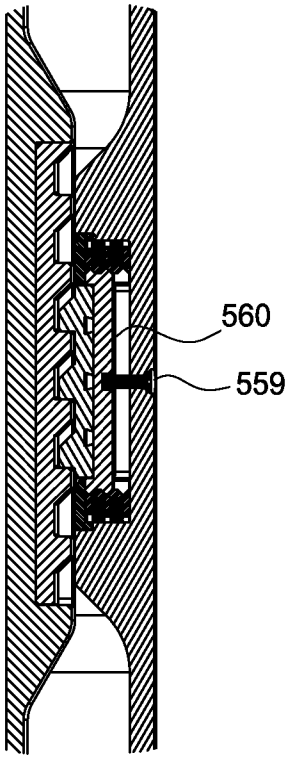
Figure 23C:
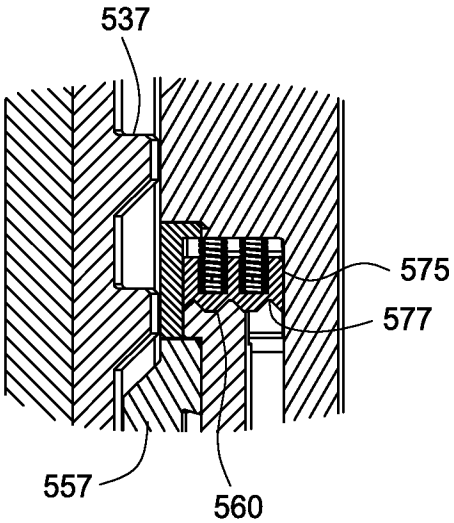
Figure 23B:
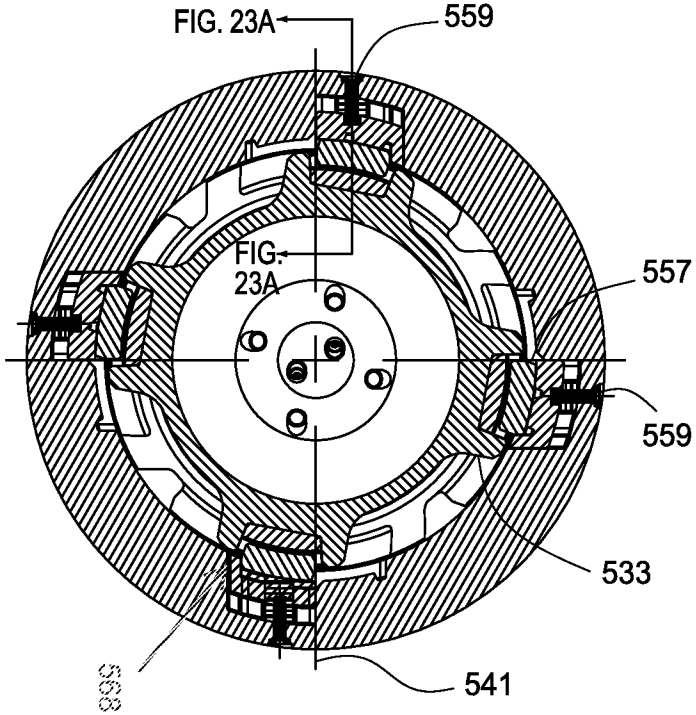

In FIGS. 23A-C, the cap screws 553 have been removed and replaced with a jack screw 559 configured to urge the elevator 560 to the extended position. In one embodiment, the jack screw 559 has a length sufficient to move the elevator 560 to the upper track 577. As shown, the jack screw 559 has moved the elevator from the lower track 577 to the upper track 577 on the ratchet 575. The keys 557 are now engaged with the keys 537 and slots 538 on the latch mandrel 530. The keys 557 are also positioned between the walls 533 of the key retainer 532. As shown FIG. 23B, the elevator 560 has raised the keys 557 in a direction substantially parallel to a radial direction (as represented by the center line 541). This movement is also shown in FIG. 23B by the parallel alignment of the moving guide 568 with respect to the centerline 541 located at one side of the elevator 560.

Figure 24B:
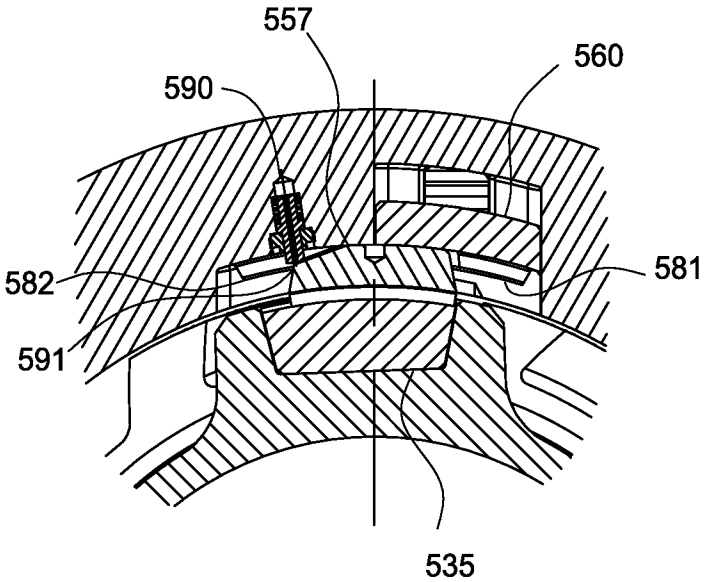
Figure 24A:
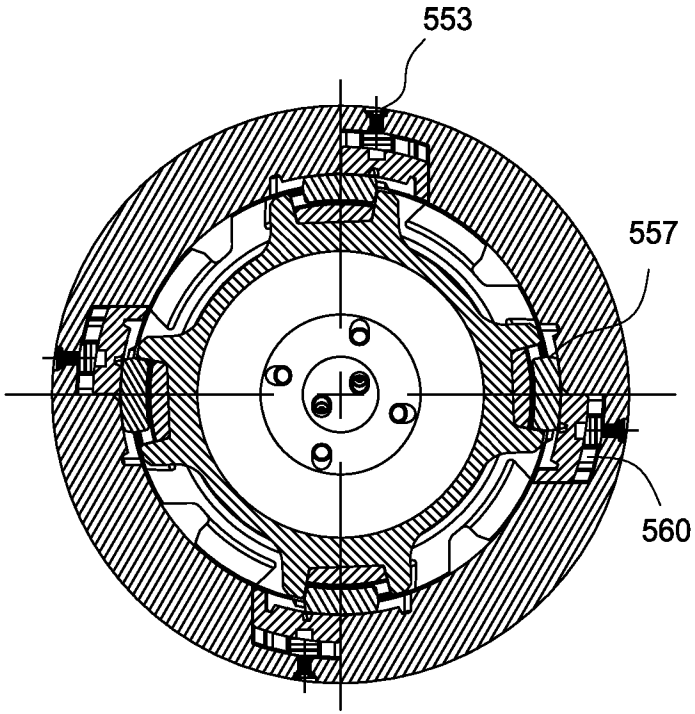

To maintain engagement of the keys 557, 537, the latch mandrel 530 is rotated counterclockwise relative to the latch housing 550. In FIGS. 24A-B, the latch mandrel 530 has been rotated counterclockwise, which moves the keys 557 to the left side 572 of the pocket 570 due to the keys 557 being positioned in the key retainer 532. In these Figures, the keys 557 are only partially rotated to the left. In FIG. 24B, the incline 591 on the back of the key support 555 has just engaged the shear pin 590. Also, the jack screws 559 have been replaced by the cap screws 553.

Figure 25B:
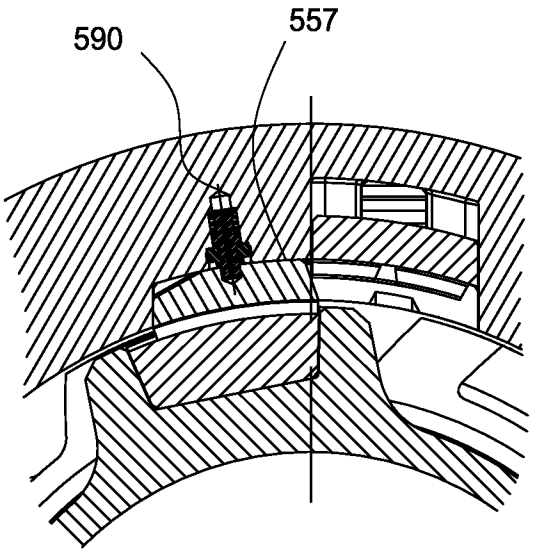
Figure 25A:
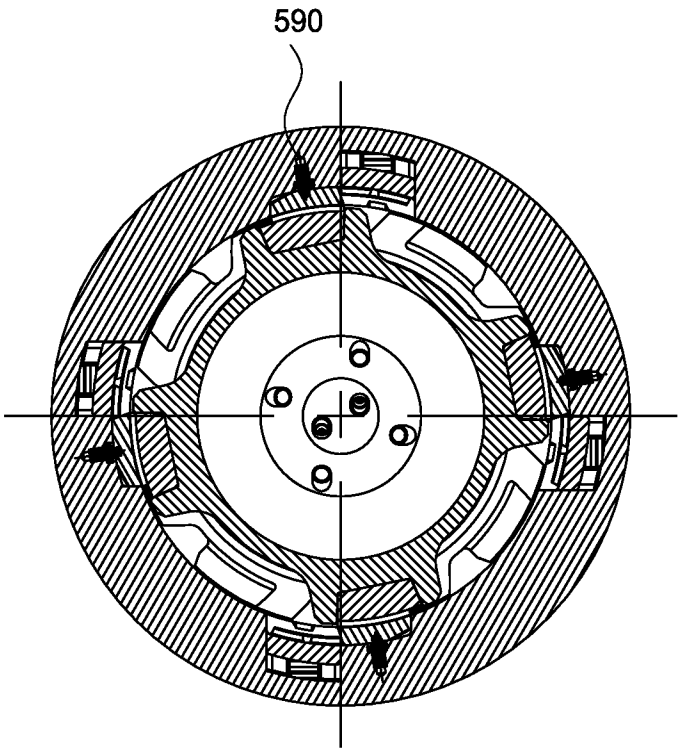

In FIGS. 25A-B, the keys 557 have completed the move to the left side 572. The shear pin 590 has cleared the incline 591 and biased in the hole on the back of the key support 555. The keys 557 are now in the locked position, thereby coupling the casing string 520, 1020 to the conductor 505, 1005. The drilling system 1000 may be completed by making up additional lengths of casing and coupling the drill string 1015 to the casing string 1020.

The drilling system 1000 is run-in on the drill string 1015 until it lands on the sea floor. The drilling system 1000 is jetted into the earth to position the conductor 1005. Alternatively, the conductor 1005 may be drilled into position. Then, the drilling system 1000 is allowed to remain in position while the formation re-settles around the conductor 1005 to support the conductor 1005. Alternatively, the conductor 1005 may be cemented in place. The casing string 1020 is then unlatched from the conductor 1005.

In another embodiment, the integrity of the bond of the conductor 1005 with the formation may be tested before the casing string 1020 is unlatched from the conductor 1005. In one example, the mating keys 537 of the latch mandrel 530 may have a flat upper surface, e.g., normal angle, and the latch keys 557 of the latch housing 550 may have a flat lower surface. To perform the test, the casing string 1020 is pulled upward so that the flat surfaces engage each other, and the upward force is transferred to the conductor 1005 to determine the integrity of the bond. Because the keys 537, 557 have flat surfaces, a zero radial resultant force is generated, thereby not causing the latch keys 557 to move out of engagement with the mating keys 537.

Figure 26B:
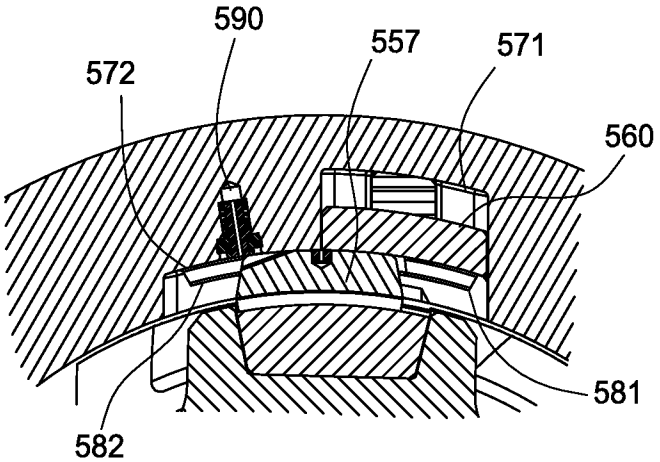
FIGS. 26A-C and 27A-B are sequential views of unlocking the latch mandrel from the latch housing of the latch assembly of FIG. 18.
Figure 26C:
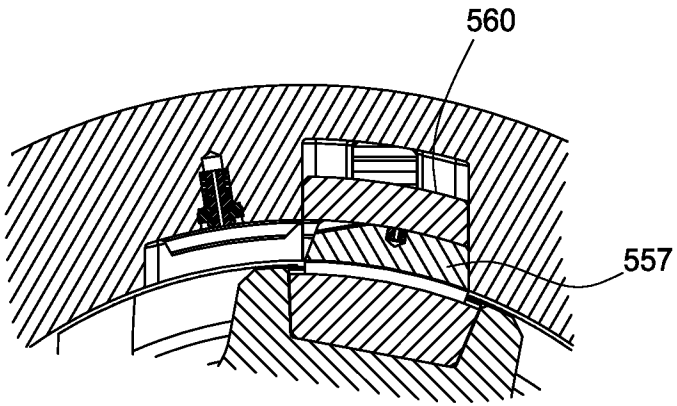
Figure 26A:
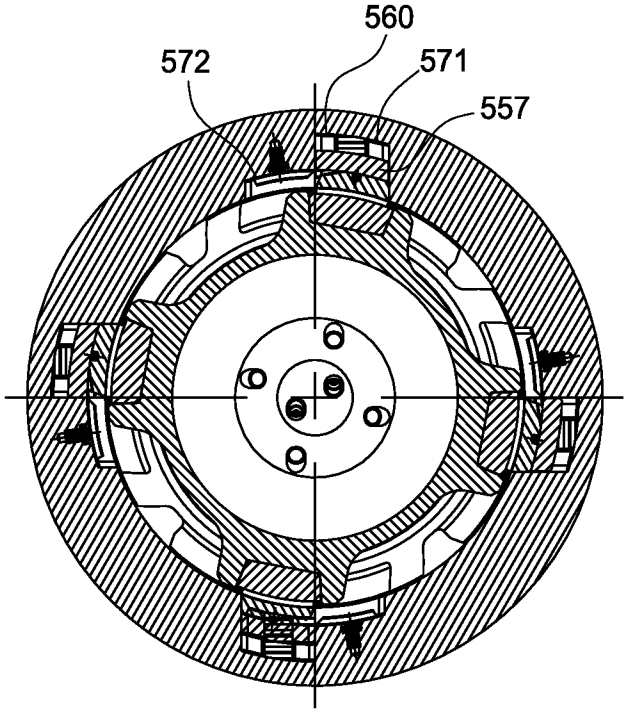

To unlatch the casing string 1020, the casing string 1020 is rotated clockwise in order to return the keys 557 to the right side 571, as shown in FIGS. 26A-C. A sufficient rotational force is applied to break the shear pin 590 in order to unlock the keys 557. In FIG. 26B, the shear pin 590 has been broken, and the keys 557 are moved partially to the right side 571 of the pocket 570. The grooves 585 on the key support 555 are partially engaged with the dovetails 582 on the left side 572 and the dovetails 581 on the elevator 560 on the right side 571. FIGS. 26A, C show the keys 557 after completing the move to the right side 571.

Figure 27A:
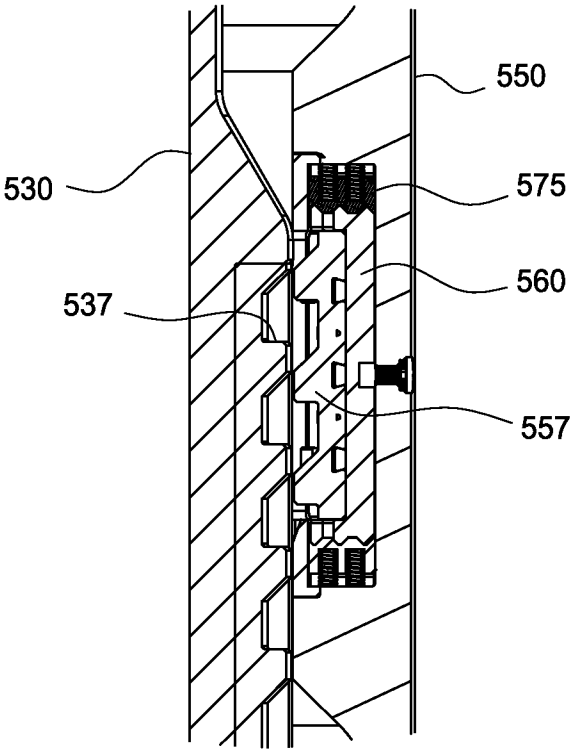
Figure 27B:
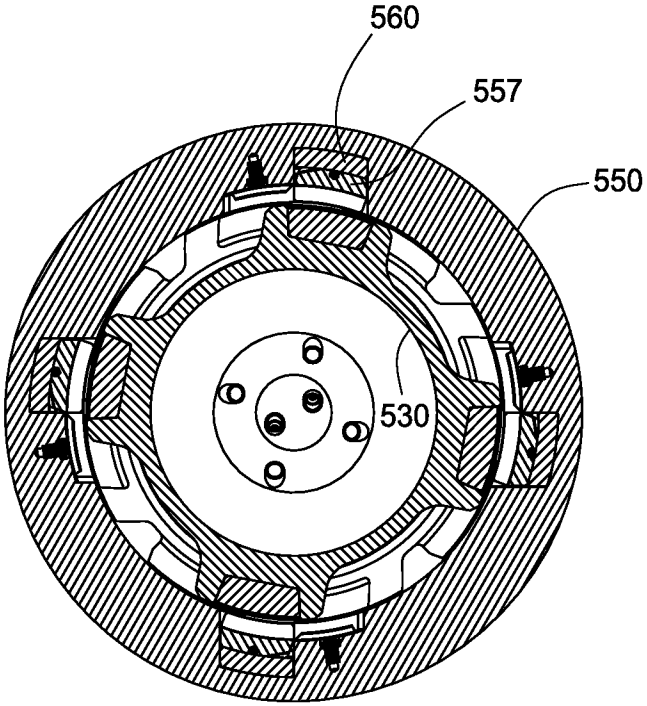

Thereafter, a downward force is applied to the casing string 1020 to retract the keys 557, as shown in FIGS. 27A-B. The downward force is transferred from the casing string 1020 to the mating keys 537 on the latch mandrel 530, and then from the mating keys 537 to the latch keys 557 on the latch housing 550. The downward facing incline on the mating keys 537 engage the upward facing incline on the latch keys 557 and force the keys 557 to move radially outward. The movement causes the elevator 560 to retract and move to the lower track on the ratchet 575. In one embodiment, the latch keys 557 are flush or recessed relative to the inner surface of the latch housing 550. In this respect, the retracted keys 557 do not present an obstruction to the axial movement of the casing string 1020. As a result of retracting the latch keys 557, the casing string 1020 is free to move axially relative to the conductor 1005. In this manner, the latch assembly 500 allows the casing string 1020 to unlatch from the conductor 1005 without use of a ball, electrical activation, hydraulic activation, or remotely operated vehicles.

Figure 28:
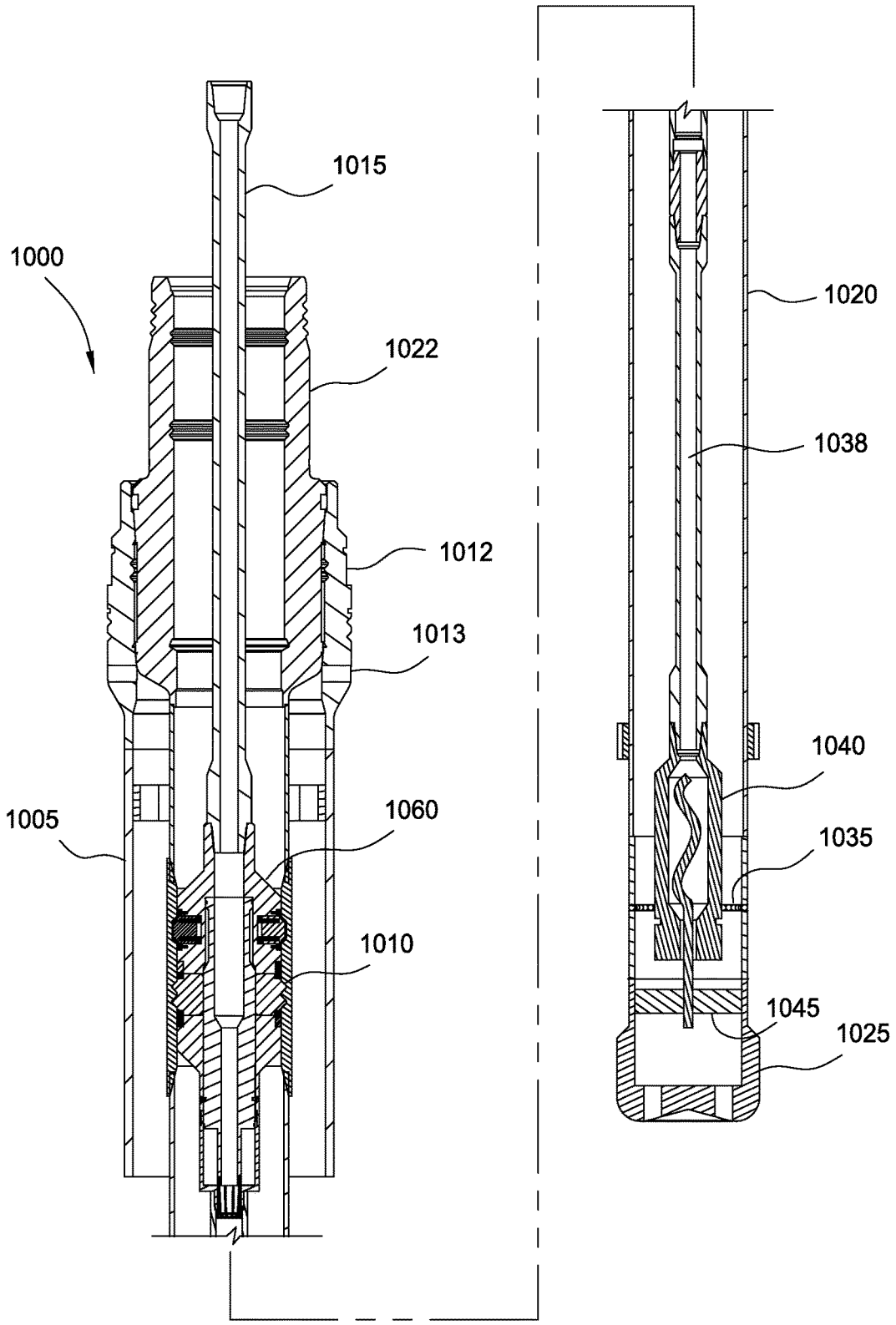
FIG. 28 shows the drilling system of FIG. 17 in operation.
Figure 29:
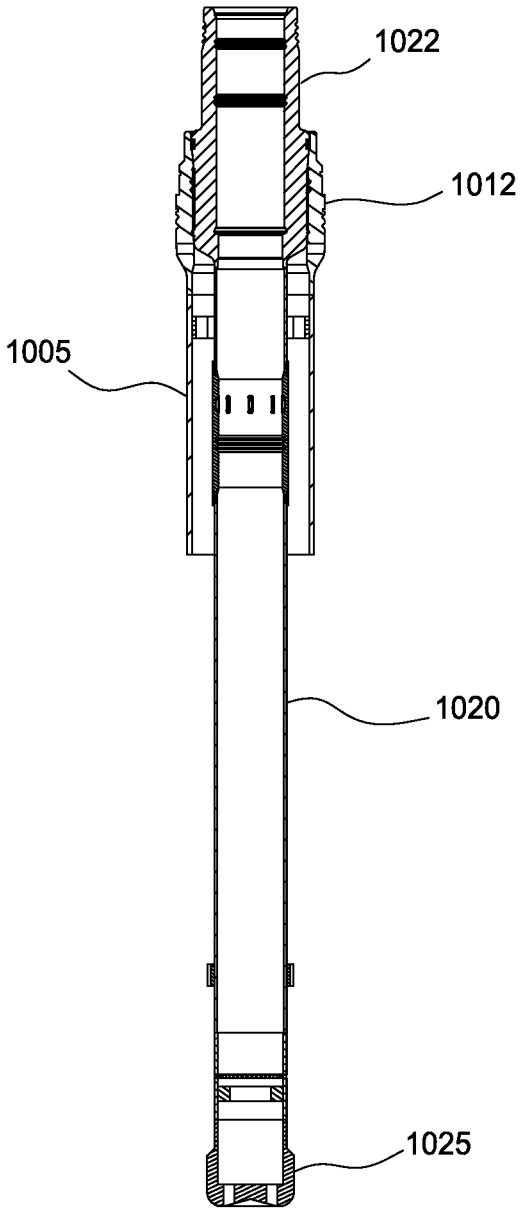
FIG. 29 shows the drilling system of FIG. 17 after the running tool and connected tools have been removed.

In one embodiment, the casing string 1020 is drilled or urged ahead. The earth removal member 1025 is rotated by the downhole drilling motor 1040 to extend the wellbore. The swivel 1035 allows the earth removal member 1025 to rotate relative to the casing string 1020. Because the casing string and the high pressure wellhead 1022 do not necessarily need to rotate, the drilling may continue while the high pressure wellhead 1022 lands in the low pressure wellhead 1012. The casing string and the high pressure wellhead may be rotated at a low RPM during drilling, but cease rotation while landing the wellhead. FIG. 28 shows the high pressure wellhead 1022 landed in the low pressure wellhead 1012. The drilling fluid circulating back up the annulus between the casing 1020 and conductor 1005 may flow out through a side port 1013 in the low pressure wellhead 1012. In another embodiment, the earth removal member 1025 may be rotated by rotating the entire casing string 1020. Optionally, prior to landing the high pressure wellhead 1022, the interior of the low pressure wellhead 1012 may be cleaned by a remotely operated vehicle. Optionally still, a debris barrier such as a wiper or seal may be provided on the exterior surface of the casing string 1020 near the high pressure wellhead 1022. The debris barrier may serve to block the flow of return fluids between the high pressure wellhead 1022 and the low pressure wellhead 1012 during the landing process, thereby facilitating the diversion of return fluid through the side ports 1013. After landing the wellhead 1022, a cementing operation is performed to cement the casing string 1020. In another embodiment, the drilling system may be equipped with sensors to monitor gas kicks in the formation. Upon completion, the running tool 1060 may be released. An activating device such as a ball, standing valve, or dart is dropped to land in the inner mandrel to close fluid communication. Pressure is increase to shift the inner mandrel and retract the dogs, thereby releasing the running tool 1060 from the setting sleeve 1010. Thereafter, the running tool 1060, inner string 1038, drilling motor 1040, and other connected instruments may be retrieved. FIG. 29 shows the drilling system 1000 after the running tool 1060 and connected tools have been removed. It must be noted that the cementing operation may occur by way of reverse circulation, for example, supplied through the side ports 1013 of the low pressure wellhead 1012.

In yet another embodiment, telemetry such as mud pulse telemetry, flow rate modulation, electromagnetic signal, and radio frequency identification tags may be used to transmit a command to operate the running tool. For example, a coded pressure signal may be sent down the bore to the running tool, where it is received by a sensor operatively connected to a controller which in turn, operates a release mechanism to allow the dogs to retract. Devices operated by pressure telemetry or other suitable remote actuation methods may also be used to activate the running tool, retractable joint, or circulation sub.

In one embodiment, a method of coupling a first tubular to a second tubular includes disposing the second tubular in the first tubular, wherein the first tubular includes a latch member and the second tubular includes a second latch member; engaging the first latch member with the second latch member by extending the first latch member toward the second latch member; maintaining engagement of the first latch member to the second latch member; and applying a downward force to retract the first latch member, thereby disengaging the first latch member from the second latch member.

In another embodiment, a latch assembly includes a latch housing having a first latch member; a latch mandrel having a second latch member, wherein the latch mandrel is disposed in the latch housing; and an elevator for extending and retracting the first latch member relative to the second latch member for engaging or disengaging the first latch member to the second latch member, wherein the first latch member is rotatable relative to the elevator to lock the first latch member in an engaged position with the second latch member.

Embodiments of the invention are described herein with terms designating orientation in reference to a vertical wellbore. These terms designating orientation should not be deemed to limit the scope of the invention. Embodiments of the invention may also be used in a non-vertical wellbore, such as a horizontal wellbore.

While the foregoing is directed to embodiments of the present invention, other and further embodiments of the invention may be devised without departing from the basic scope thereof, and the scope thereof is determined by the claims that follow.

The invention claimed is:

1. A method of coupling a first tubular to a second tubular, comprising:

disposing the second tubular in the first tubular, wherein the first tubular includes a first latch member and the second tubular includes a second latch member;

engaging the first latch member with the second latch member by extending the first latch member toward the second latch member;

rotating the first latch member and the second latch member relative to the first tubular to move the first latch member to a lock position; and applying an axial force to retract the first latch member, thereby disengaging the first latch member from the second latch member.

2. The method of claim 1, further comprising rotating the first latch member relative to the first tubular to unlock the first latch member before applying the axial force.

3. The method of claim 1, wherein the first latch member is rotated by rotating the second tubular.

4. The method of claim 1, further comprising using a pin to lock the first latch member in the lock position.

5. The method of claim 1, wherein the first latch member is extended in a direction substantially parallel to a radial direction.

6. A latch assembly, comprising:

a latch housing having a first latch member;

a latch mandrel having a second latch member, wherein the latch mandrel is disposed in the latch housing; and an elevator for extending and retracting the first latch member relative to the second latch member for engaging or disengaging the first latch member to the second latch member, wherein the first latch member is rotatable relative to the elevator to lock the first latch member in an engaged position with the second latch member; wherein in the engaged position, the second latch member is rotatable with the first latch member relative to the elevator.

7. The latch assembly of claim 6, wherein the first latch member is configured to extend in a direction substantially parallel to a radial direction.

8. The latch assembly of claim 7, further comprising a pocket in the latch housing for receiving the elevator and the first latch member.

9. The latch assembly of claim 8, further comprising a ratchet for controlling movement of the elevator.

10. The latch assembly of claim 6, further comprising a pocket in the latch housing for receiving the elevator and the first latch member.

11. The latch assembly of claim 6, wherein the first latch member is coupled to the elevator using a dovetail connection.

12. The latch assembly of claim 6, further comprising a ratchet for controlling movement of the elevator.

13. The latch assembly of claim 6, further comprising a shearable pin for locking the first latch member.

14. The latch assembly of claim 6, wherein the first latch member is rotatable relative to the elevator to unlock the first latch member from the engaged position with the second latch member.

15. A casing assembly comprising:

a first casing having a first latch member;

a second casing having a second latch member, wherein the second casing is disposed in the first casing; and an elevator for extending and retracting the first latch member relative to the second latch member, wherein the first latch member is rotatable relative to the elevator to lock the first latch member in an engaged position with the second latch member; wherein in the engaged position, the second latch member is rotatable with the first latch member relative to the elevator.

16. The casing assembly of claim 15, further comprising a drilling string coupled to the second casing.

17. The casing assembly of claim 15, wherein the first latch member is configured to extend in a direction substantially parallel to a radial direction.

18. The casing assembly of claim 15, further comprising a pocket in the latch housing for receiving the elevator and the first latch member.

19. The casing assembly of claim 15, wherein the first latch member is coupled to the elevator using a dovetail connection.

* * * * *